US012378866B1

(12) United States Patent
Latimer et al.

(10) Patent No.: US 12,378,866 B1
(45) Date of Patent: Aug. 5, 2025

(54) CONTROLLING FRACTURE GROWTH DURING STIMULATION OF SUBSURFACE RESERVOIRS USING OFFSET WELLS

(71) Applicant: Fervo Energy Company, Houston, TX (US)

(72) Inventors: Timothy Latimer, Houston, TX (US); Jack Norbeck, Golden, CO (US)

(73) Assignee: Fervo Energy Company, Houston, TX (US)

( * ) Notice: Subject to any disclaimer, the term of this patent is extended or adjusted under 35 U.S.C. 154(b) by 0 days.

(21) Appl. No.: 18/234,220

(22) Filed: Aug. 15, 2023

Related U.S. Application Data

(60) Provisional application No. 63/398,070, filed on Aug. 15, 2022.

(51) Int. Cl.
*E21B 43/267* (2006.01)
*E21B 43/24* (2006.01)
*F24T 50/00* (2018.01)

(52) U.S. Cl.
CPC ..... *E21B 43/267* (2013.01); *E21B 43/24* (2013.01); *F24T 50/00* (2018.05)

(58) Field of Classification Search
None
See application file for complete search history.

(56) References Cited

U.S. PATENT DOCUMENTS

| | | | | |
|---|---|---|---|---|
| 4,005,750 | A * | 2/1977 | Shuck | E21B 43/26 166/308.1 |
| 7,748,458 | B2 * | 7/2010 | Hocking | E21B 43/26 166/308.1 |
| 9,410,406 | B2 * | 8/2016 | Yuan | E21B 43/26 |
| 10,934,825 | B2 * | 3/2021 | An | E21B 43/261 |
| 2008/0249721 | A1 * | 10/2008 | Zoback | E21B 49/00 702/42 |
| 2016/0215604 | A1 * | 7/2016 | Potapenko | E21B 43/263 |
| 2019/0234194 | A1 * | 8/2019 | Dusterhoft | E21B 43/2607 |
| 2021/0301652 | A1 * | 9/2021 | Zhang | E21B 43/26 |

* cited by examiner

*Primary Examiner* — Andrew Sue-Ako
(74) *Attorney, Agent, or Firm* — Schwegman Lundberg & Woessner, P.A.

(57) ABSTRACT

Systems and techniques may be used to increase recovery of a geothermal energy resource. An example technique includes selecting a first borehole that extends from a surface of the earth into a first location in a geothermal reservoir, conditioning the first borehole by pumping a fluid into or out of the first borehole at a predetermined operating condition to change a property of the geothermal reservoir, and selecting a second borehole that extends from the surface of the earth into a second location in the geothermal reservoir. The example technique may include enhancing permeability of the geothermal reservoir by using a reservoir stimulation technique on the second borehole, wherein a property of a stimulated reservoir volume is controlled by the property of the geothermal reservoir that was changed by conditioning the first borehole.

17 Claims, 26 Drawing Sheets

CONTROLLING FRACTURE GROWTH DURING STIMULATION OF SUBSURFACE RESERVOIRS USING OFFSET WELLS

CLAIM OF PRIORITY

This international application claims the benefit of priority to U.S. Provisional Patent Application Ser. No. 63/398,070 filed Aug. 15, 2022, titled "A METHOD TO CONTROL FRACTURE GROWTH DURING STIMULATION OF SUBSURFACE RESERVOIRS USING OFFSET WELLS," the contents of which is hereby incorporated by reference herein in its entirety.

BACKGROUND

Typically, in the production of natural resources from formations within the earth a well or borehole is drilled into the earth to the location where the natural resource is believed to be located. These natural resources may be a heat source for geothermal energy, a hydrocarbon reservoir, containing natural gas, crude oil and combinations of these; the natural resource may be fresh water; or it may be some other natural resource that is located within the ground.

These resource-containing formations may be a few hundred feet, a few thousand feet, or tens of thousands of feet below the surface of the earth, including under the floor of a body of water, e.g., below the sea floor. In addition to being at various depths within the earth, these formations may cover areas of differing sizes, shapes and volumes.

Unfortunately, and generally, when a well is drilled into these formations the natural resources rarely flow into and out of the formation, and into the well at rates, durations and amounts that are economically viable. This problem occurs for several reasons, some of which are well understood, others of which were not as well understood, some of which may not yet be known, and several of which, prior to the present systems and techniques were incorrect. These problems can relate to the viscosity of the natural resource, the porosity of the formation, the geology of the formation, the formation pressures, and the perforations that place the production tubing in the well in fluid communication with the formation, to name a few.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various examples discussed in the present document.

DETAILED DESCRIPTION

Figure 1:
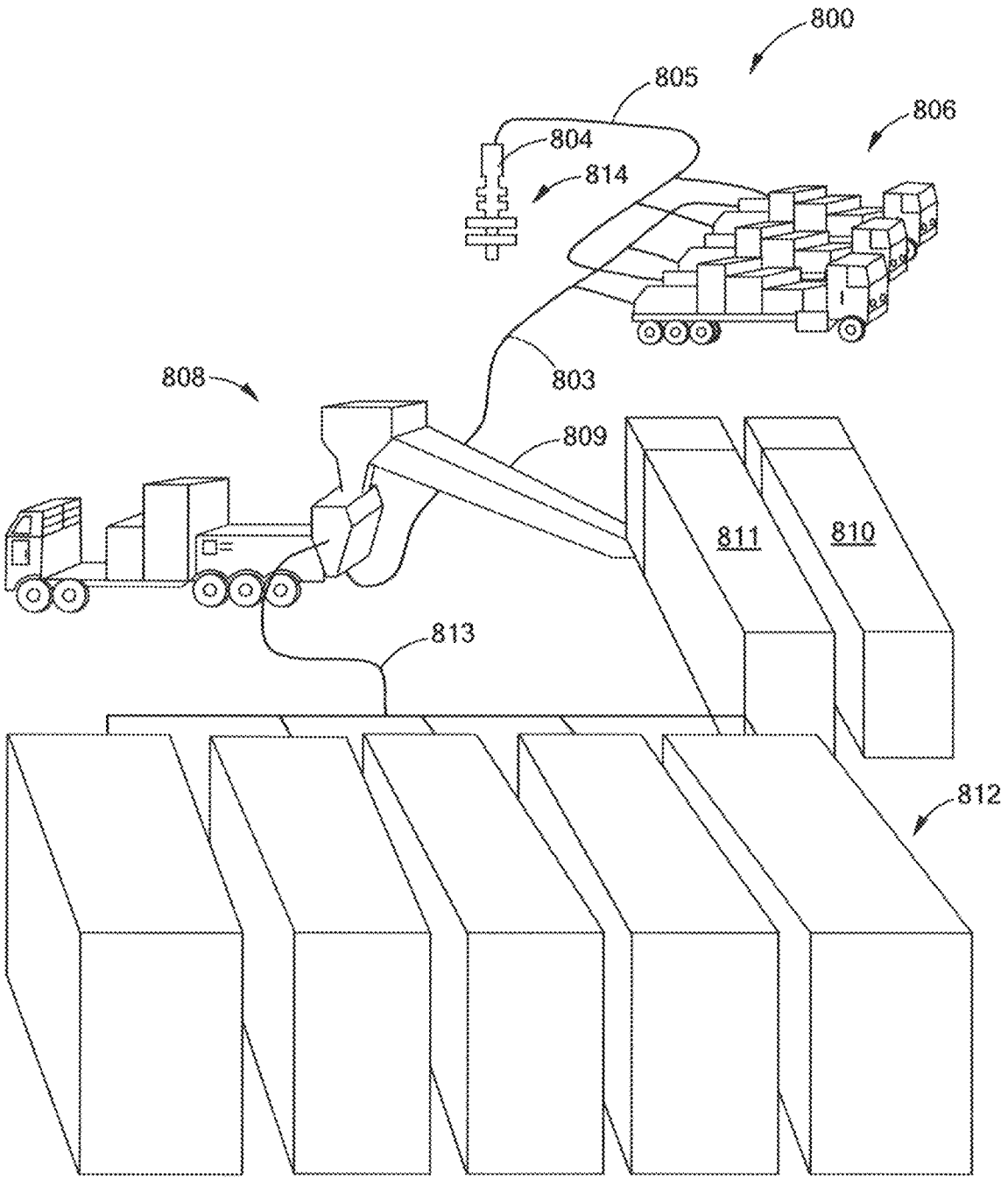
FIG. 1 illustrates a perspective view of a hydraulic fracturing site in accordance with examples described herein.

Typically, and by way of general illustration, in drilling a well an initial borehole is made into the earth, e.g., the surface of land or seabed, and then subsequent and smaller diameter boreholes are drilled to extend the overall depth of the borehole. In this manner as the overall borehole gets deeper its diameter becomes smaller; resulting in what can be envisioned as a telescoping assembly of holes with the largest diameter hole being at the top of the borehole closest to the surface of the earth.

Typically, when completing a well, it is necessary to perform a perforation operation. In general, when a well has been drilled and casing, e.g., a metal pipe, is run to the prescribed depth, the casing is typically cemented in place by pumping cement down and into the annular space between the casing and the earth. (It is understood that many different down hole casing, open hole, and completion approaches may be used.) The casing, among other things, prevents the hole from collapsing and fluids from flowing between permeable zones in the annulus. Thus, this casing forms a structural support for the well and a barrier to the earth.

While important for the structural integrity of the well, the casing and cement present a problem when they are in the production zone. Thus, in addition to holding back the earth, they also prevent the resources or fluid from flowing into and out of the well and from being recovered. Additionally, the formation itself may have been damaged by the drilling process, e.g., by the pressure from the drilling mud, and this damaged area of the formation may form an additional barrier to the flow of resources. Similarly, in most situations where casing is not needed in the production area, e.g., open hole, the formation itself is generally tight, and more typically can be very tight, and thus, will not permit the flow of resources into and out of the well.

To address, in part, this problem of the flow of resources e.g., geothermal, hydrocarbons, etc. into the well being blocked by the casing, cement and the formation itself, openings, e.g., perforations, are made in the well in the area of the pay zone. Generally, a perforation is a small, about ¼ " to about 1" or 2" in diameter hole that extends through the casing, cement and damaged formation and goes into the formation. This hole creates a passage for the resource to flow from the formation into the well. In a typical well, a large number of these holes are made through the casing and into the formation in the pay zone.

As used herein, unless specified otherwise, the term "earth" should be given its broadest possible meaning, and includes, the ground, all natural materials, such as rocks, and artificial materials, such as concrete, that are or may be found in the ground, including without limitation rock layer formations, such as, granite, basalt, sandstone, dolomite, sand, salt, limestone, rhyolite, quartzite and shale rock.

As used herein, unless specified otherwise, the term "borehole" should be given it broadest possible meaning and includes any opening that is created in a material, a work piece, a surface, the earth, a structure (e.g., building, protected military installation, nuclear plant, offshore platform, or ship), or in a structure in the ground, (e.g., foundation, roadway, airstrip, cave or subterranean structure) that is substantially longer than it is wide, such as a well, a well bore, a well hole, a micro hole, slimhole, a perforation and other terms commonly used or known in the arts to define these types of narrow long passages. Wells may further include exploratory, production, abandoned, reentered, reworked, and injection wells. Although boreholes are generally oriented substantially vertically, they may also be oriented on an angle from vertical, to and including horizontal. Thus, using a vertical line, based upon a level as a reference point, a borehole can have orientations ranging from 0° i.e., vertical, to 90°, i.e., horizontal and greater than 900 e.g., such as a heel and toe and combinations of these such as for example "U" and "Y" shapes. Boreholes may further have segments or sections that have different orientations, they may have straight sections and arcuate sections and combinations thereof; and for example may be of the shapes commonly found when directional drilling is employed. Thus, as used herein unless expressly provided otherwise, the "bottom" of a borehole, the "bottom surface" of the borehole and similar terms refer to the end of the borehole, i.e., that portion of the borehole furthest along the path of the borehole from the borehole's opening, the surface of the earth, or the borehole's beginning. The terms "side" and "wall" of a borehole should to be given their broadest possible meaning and include the longitudinal surfaces of the borehole, whether or not casing or a liner is present, as such, these terms may include the sides of an open borehole or the sides of the casing that has been positioned within a borehole. Boreholes may be made up of a single passage, multiple passages, connected passages and combinations thereof, in a situation where multiple boreholes are connected or interconnected each borehole may have a borehole bottom. Boreholes may be formed in the sea floor, under bodies of water, on land, in ice formations, or in other locations and settings.

Boreholes are generally formed and advanced by using mechanical drilling equipment having a rotating drilling tool, e.g., a bit. For example and in general, when creating a borehole in the earth, a drilling bit is extending to and into the earth and rotated to create a hole in the earth. In general, to perform the drilling operation the bit must be forced against the material to be removed with a sufficient force to exceed the shear strength, compressive strength or combinations thereof, of that material. Thus, in conventional drilling activity mechanical forces exceeding these strengths of the rock or earth must be applied. The material that is cut from the earth is generally known as cuttings, e.g., waste, which may be chips of rock, dust, rock fibers and other types of materials and structures that may be created by the bit's interactions with the earth. These cuttings are typically removed from the borehole by the use of fluids, which fluids can be liquids, foams or gases, or other materials know to the art.

As used herein, unless specified otherwise, the term "advancing" a borehole should be given its broadest possible meaning and includes increasing the length of the borehole. Thus, by advancing a borehole, provided the orientation is not horizontal, e.g., less than 900 the depth of the borehole may also be increased. The true vertical depth ("TVD") of a borehole is the distance from the top or surface of the borehole to the depth at which the bottom of the borehole is located, measured along a straight vertical line. The measured depth ("MD") of a borehole is the distance as measured along the actual path of the borehole from the top or surface to the bottom. As used herein unless specified otherwise the term depth of a borehole may refer to MID. In general, a point of reference may be used for the top of the borehole, such as the rotary table, drill floor, well head or initial opening or surface of the structure in which the borehole is placed.

As used herein, unless specified otherwise, the terms "workover," "completion" and "workover and completion" and similar such terms should be given their broadest possible meanings and may include activities that place at or near the completion of drilling a well, activities that take place at or the near the commencement of production from the well, activities that take place on the well when the well is producing or operating well, activities that take place to reopen or reenter an abandoned or plugged well or branch of a well, and may also include for example, perforating, cementing, acidizing, fracturing, pressure testing, the removal of well debris, removal of plugs, insertion or replacement of production tubing, forming windows in casing to drill or complete lateral or branch wellbores, cutting and milling operations in general, insertion of screens, stimulating, cleaning, testing, analyzing and other such activities. These terms may further include applying heat, directed energy, optionally in the form of a high power laser beam to heat, melt, soften, activate, vaporize, disengage, desiccate and combinations and variations of these, materials in a well, or other structure, to remove, assist in their removal, cleanout, condition and combinations and variation of these, such materials.

Generally, the term "about" as used herein unless stated otherwise is meant to encompass a variance or range of 10%, the experimental or instrument error associated with obtaining the stated value, and optionally the larger of these.

As used herein, unless specified otherwise, the terms "formation," "reservoir," "pay zone," and similar terms, are to be given their broadest possible meanings and may include all locations, areas, and geological features within the earth that contain, may contain, or are believed to contain, the desired resource, e.g., geothermal heat, hydrocarbons, etc.

As used herein, unless specified otherwise, the terms "field," "oil field" "geothermal field" and similar terms, are to be given their broadest possible meanings, and may include any area of land, sea floor, or water that is loosely or directly associated with a formation, and more particularly with a resource containing formation, thus, a field may have one or more exploratory and producing wells associated with it, a field may have one or more governmental body or private resource leases associated with it, and one or more field(s) may be directly associated with a resource containing formation.

As used herein, unless specified otherwise, the terms "conventional gas", "conventional oil", "conventional", "conventional production" and similar such terms are to be given their broadest possible meaning and include hydrocarbons, e.g., gas and oil, that are trapped in structures in the earth. Generally, in these conventional formations the hydrocarbons have migrated in permeable, or semi-permeable formations to a trap, or area where they are accumulated. Typically, in conventional formations a non-porous layer is above, or encompassing the area of accumulated hydrocarbons, in essence trapping the hydrocarbon accumulation. Conventional reservoirs have been historically the sources of the vast majority of hydrocarbons produced. As used herein, unless specified otherwise, the terms "unconventional gas", "unconventional oil", "unconventional", "unconventional production" and similar such terms are to be given their broadest possible meaning and includes hydrocarbons that are held in impermeable rock, and which have not migrated to traps or areas of accumulation.

As used herein, unless specified otherwise, the terms "hydrocarbon exploration and production", "exploration and production activities", "E&P", and "E&P activities", and similar such terms are to be given their broadest possible meaning, and include surveying, geological analysis, well planning, reservoir planning, reservoir management, drilling a well, workover and completion activities, hydrocarbon production, flowing of hydrocarbons from a well, collection of hydrocarbons, secondary and tertiary recovery from a well, the management of flowing hydrocarbons from a well, and any other upstream activities.

As used herein, unless specified otherwise, the terms "poroelastic", "poroelasticity", "poroelastic stresses", "poroelastic forces" and similar such terms should be given their broadest possible meanings and may include the forces, stresses and effects that are based upon the interaction between fluid flow and solid deformation within a porous medium. Typically, in evaluating poroelastic effects Darcy's law, which describes the relation between fluid motion and pressure within a porous medium, is coupled with the structural displacement of the porous matrix. Thermal stresses are mathematically analogous to poroelastic stresses, except that they are caused by expansion or contraction of rock due to changes in temperature.

As used herein, unless specified otherwise, the terms "geothermal", "geothermal well", "geothermal resource", "geothermal energy" and similar such terms, should be given their broadest possible meaning and including wells, systems and operations that recover or utilize the heat energy that is contained within the earth. Such systems and operations may include enhanced geothermal well, engineered geothermal wells, binary cycle power plants, dry steam power plants, flash steam power plants, open looped systems, and closed loop systems.

The ability of, or ease with which, the natural resource can flow out of the formation and into the well or production tubing (into and out of, for example, in the case of engineered geothermal wells, and some advanced recovery methods for hydrocarbon wells) can generally be understood as the fluid communication between the well and the formation. As this fluid communication is increased several enhancements or benefits may be obtained: the volume or rate of flow (e.g., gallons per minute) can increase; the distance within the formation out from the well where the natural resources will flow into the well can be increase (e.g., the volume and area of the formation that can be drained by a single well is increased, and it will thus take less total wells to recover the resources from an entire field); the time period when the well is producing resources can be lengthened; the flow rate can be maintained at a higher rate for a longer period of time; and combinations of these and other efficiencies and benefits.

Fluid communication between the formation and the well can be increased by the use of hydraulic stimulation techniques. The first uses of hydraulic stimulation date back to the late 1940s and early 1950s. In general, hydraulic treatments involve forcing fluids down the well and into the formation, where the fluids enter the formation and crack, e.g., force the layers of rock to break apart or fracture. These fractures create channels or flow paths that may have cross sections of a few micron's, to a few millimeters, to several millimeters in size, and potentially larger. The fractures may also extend out from the well in all directions for a few feet, several feet and tens of feet or further. It should be remembered that the longitudinal axis of the well in the reservoir may not be vertical: it may be on an angle (either slopping up or down) or it may be horizontal. The section of the well located within the reservoir, i.e., the section of the formation containing the natural resources, can be called the pay zone.

Although hydraulic stimulation has been used in geothermal wells, the use of proppants has generally not been used, and its use has been discredited by those in the art.

Generally, in prior geothermal wells, even those that have been hydraulically stimulated, the performance and efficiency of the well, and geothermal power plant, has been less than desirable and suboptimal. This suboptimal performance has hindered the adoption of geothermal energy, making its replace of hydrocarbon energy sources difficult. This suboptimal performance has reduced the ability of geothermal energy, which is a clean, carbon free energy source, from being widely adopted and replacing carbon emitting, e.g., coal, oil, natural gas, power generation sources.

This low efficiency or lack of performance in geothermal wells is also seen in the inefficiency of the recovery of oil and natural gasses from hydrocarbon wells, i.e., wells that are production hydrocarbons.

One of the reasons for this lack of efficiency, and suboptimal performance of wells, e.g., geothermal and hydrocarbon, occurs because in unconventional oil and gas reservoir it is necessary to increase the permeability of the reservoir through hydraulic stimulation to achieve commercially viable production. In some geothermal reservoirs, hydraulic stimulation is also used. Typically, in the oil and gas industry, hydraulic fracturing is the stimulation method, where fluid is injected at relatively high pressures to cause new tensile fractures to form. In the geothermal industry, the most common stimulation method is called hydroshearing, where fluid is injected at pressures sufficiently high to cause shear slip and dilation on preexisting natural fractures. These prior techniques, however, have many short communing and have, among other things lead to the lack of efficiency in the recovery of energy from boreholes in the earth.

Both the hydraulic fracturing and hydroshearing methods are controlled largely by the in-situ state of stress, which can be influenced by many factors including: depth, remote tectonic forces, local material heterogeneity, thermoporoelastic effects, faulting, fluid flow, stress concentrations due to wellbores, and combinations and various of these, as well as other factors. In the hydraulic fracturing method, fluid pressure must exceed the magnitude of the minimum principal stress to ensure formation and growth of new tensile fractures. In the hydroshearing method, fluid pressure must locally be sufficiently high such that the shear stresses driving slip on fractures overcome the frictional resistance to slip. The stress state is typically measured at the onset of a project and the stimulation treatments are designed based on the initial characterization; however, thermo-hydromechanical effects can cause the state of stress to evolve during a treatment, which are generally not managed or controlled by these prior techniques. The stress state can also change during the production phase, which is generally not managed or controlled by these prior techniques. Refracturing treatments, commonly performed in oil and gas wells that declined in production rate, may consider how the stress orientations rotated due to poroelastic effects, but generally not in a dynamic manner and not during, or as a planning or actual tool in performing the refracturing operation. The systems and techniques described herein may be used for enhancing the recovery of resources from within the ground. In particular, examples of the present systems and techniques relate to novel systems and operations to alter, modify and change subterranean formations through hydraulic stimulation operations to enhance the recovery of resources from those formations. The systems and techniques described herein relate to the recovery of subsurface resources, such as minerals, ores, gems, metals, water and energy sources including hydrocarbon and geothermal.

In an example, a low-stress region is created by placing a well on production; hydraulic stimulation is performed on an offset well to the producing well, and fracture growth into the low-stress regions of the producing well is encouraged.

In an example, a low-stress region is created by placing a well on production; hydraulic stimulation is performed on an offset well to the producing well, and fracture growth into the low-stress regions of the producing well is encouraged such that a 'frac hit' occurs effectively connecting the two wells.

In an example, a high-stress region in a producing well is created by injecting fluid into a well to increase pressure, temperature, and both, thereby inducing poroelastic stresses, thermal stresses, and both, that increase the complexity of the fractures and fluid communication pathways between the two wells.

In an example hydraulic stimulation is performed on an offset well, and propagating fractures in the producing well are encouraged to turn or branch away from the high-stress region created by the stimulation in the offset well.

In an example, mechanically-induced stress changes caused by fracture propagation and deformation (i.e., 'stress shadowing') is taken advantage of to encourage fractures to propagate away from the wellbore in an asymmetric fashion, and accounted for in terms of fracture spacing connecting offset wells.

In an example, the fluid pressure and flow rates are manipulated in two adjacent wellbores connected by a fracture to control fracture closure and proppant immobilization.

In an example, distributed acoustic, distributed temperature, and distributed strain fiber optic sensing cables installed in one well are used to evaluate properties of fractures propagating away from an offset well; this information is used to adjust the stimulation treatment parameters in real-time.

In general, the systems and techniques described herein relate to influencing, controlling, characterizing, or observing the growth of the stimulated reservoir volume during hydraulic stimulation treatments in subsurface reservoirs, with application to oil and gas, geothermal energy, and mining activities.

The systems and techniques described herein include controlling fluid flow and heat flow between wellbores though the use of creating stress levels in adjacent stimulation wells, and through controlled use of poroelastic conditions of the formation in near the producing well to be used for a stimulation plan and delivery through, or by way, of the adjacent well.

The systems and techniques described herein have application to oil and gas activities, such as waterflooding, steam flooding, steam assisted gravity drainage, and enhanced oil recovery. The systems and techniques described herein have application to geothermal energy activities, where thermal energy is extracted from subsurface formations by circulating a working fluid, such as water or carbon dioxide, through the formation and recovering the heated fluid.

The commercial viability of a geothermal power system depends on the long-term thermal sustainability of the reservoir. Thermal energy recovery efficiency is defined as the amount of heat recovered over the lifetime of a project relative to the initial amount of heat in place. Thermal breakthrough is defined as the time at which the temperature of the produced fluid has dropped by a threshold amount, which is controlled by the rate at which the thermal front propagates through the reservoir. The systems and techniques described herein include design of geothermal reservoir systems to control heat recovery efficiency and thermal breakthrough to improve the system's thermal sustainability.

In an example, the systems and techniques described herein may be used for recovery of geothermal resources and hydrocarbon resources from beneath the surface of the earth. In other examples, the systems and techniques described herein may be used for drilling or completing wells, or well configurations in the recovery of minerals and ores, and other resources within the ground.

In general, examples of the present well configurations have one, two, three, four or more wells. These wells can be vertical, vertical with horizontal section, vertical with sloped section, branched configurations, comb configurations, combinations and variations of these, and other configurations known to or later developed by the art and combinations and variations of these. These wells can have a TVD of from about 1,000 feet (ft) to about 20,000 ft, from about 2,000 ft to about 10,000 ft, about 2,000 ft to about 15,000 ft, and all values within these ranges, as well as larger and smaller values. These wells can have MD from about 1,000 feet (ft) to about 25,000 ft, from about 2,000 ft to about 10,000 ft, about 2,000 ft to about 15,000 ft, and all values within these ranges, as well as larger and smaller values.

In FIG. 1 there is shown a perspective view of a hydraulic fracturing site 800. Thus, positioned near the well head 814 there are, pumping trucks 806, proppant, e.g., sand, ceramic, resin coated, etc., storage containers 810, 811, a proppant feeder assembly 809, a mixing truck 808, and fracturing fluid holding units 812. It is understood that FIG. 1 is an illustration and simplification of a fracturing site. Such sites may have more, different, and other pieces of equipment such as pumps, holding tanks, mixers, and chemical holding units, mixing and addition equipment, lines, valves and transferring equipment, as well as control and monitoring equipment.

A high-pressure line 805 that transfers high pressure fracturing fluid from the pump trucks 806 into the well. The wellhead 804 may also have further well control devices associated with it, such as a BOP. Fracturing fluid from holding units 812 is transferred through lines 813 to mixing truck 808, where proppant from storage containers 810, 811 is feed, (metered in a controlled fashion) by assembly 809 and mixed with the fracturing fluid. The fracturing fluid and proppant mixture is then transferred to the pump trucks 806, by line 803, where the pump trucks 806 pump the fracturing fluid into the well by way of high pressure line 805.

In some examples, the proppants are mixed with fracking fluids for down hole hydraulic fracturing operations to, for example, recover hydrocarbons, such as crude oil and natural gas. Typically, between about 0.1 and about 12 lbs/gal, between about 3 and about 10 lbs/gal, between about 0.1 and about 1 lbs/gal, between about 1.1 and about 2 lbs/gal, between about 2.1 and about 4 lbs/gal, and between about 3.1 and about 8 lbs/gal of proppants are mixed into fracking fluid, greater and lesser amounts than about 12 lbs/gal and about 1 lbs/gal are also contemplated. Typically, at least about 10,000 gals, at least about 100,000 gals, at least about 1,000,000 gals and more of fracking fluid are used in a fracking operation. Thus, in general hundreds of thousands, if not millions of pounds of proppant, may be used in a single hydraulic fracturing operation.

In an example of the systems and techniques described herein, fractures initiating at one well, e.g., the stimulation well, are encouraged to propagate toward an adjacent well, e.g., the production well, by manipulating the stress field near the adjacent well, e.g., the production well. The stress field in a reservoir can be manipulated or changed in a way that is predictable (based on the theory of porothermoelasticity) by causing pressure or temperature changes in the reservoir rock through, for example, injection or production of fluids. Fractures are encouraged to propagate into low-stress regions of the reservoir. The adjacent wellbore may be set on production for a significant period of time prior to the stimulation treatment in the first well. The pressure depletion that occurs due to production may cause a poroelastic stress change in the reservoir that may have the effect of reducing the compressive stress, effectively creating a low-stress zone near the adjacent wellbore. As fractures propagate away from the first well, they may be encouraged to propagate into the low-stress region toward the adjacent wellbore. In some cases, the propagating fractures may intersect and connect with the adjacent well. These newly created fractures near the producing well increase conductivity of the reservoir with the production well and thus increase production from that well or circulation rates between the wells.

In an example of the systems and techniques described herein, fractures initiating at one well, e.g., the stimulation well, are encouraged to turn and branch as they approach an adjacent well, the production well, by manipulating the stress field near the adjacent well. Fractures are discouraged from propagating into high-stress regions of the reservoir. Fluid injection occur into the adjacent wellbore for a significant period of time prior to the stimulation treatment in the first well. The pressurization that occurs due to injection may cause a poroelastic stress change in the reservoir that may have the effect of increasing the compressive stress, effectively creating a high stress zone near the adjacent wellbore. As fractures propagate away from the first well, they may be discouraged from propagating into the high-stress region and may tend to bend or branch away from their original path. The complex fracture growth may encourage intersection with other tensile or preexisting fractures, increasing effective fracture surface area and reservoir pore volume. These newly created fractures near the producing well increase conductivity of the reservoir with the production well and thus increase production from that well as well as increasing the residence time for fluid flowing between wells.

In an example, the stress changes induced by fracture propagation and deformation (i.e., "stress shadowing") is taken advantage of to encourage fractures to propagate away from the wellbore in an asymmetric fashion. For example, in a system containing one injection well and two offset production wells, where the injection well is stimulated hydraulically, for every two fractures that propagate away from the injection well, only one fracture intersects each offset well (see FIG. 15). In this manner, the fracture spacing can be designed to improve thermal sustainability.

In one example of the systems and techniques described herein, the fluid pressure and flow rate conditions in two wellbores connected by a fracture are manipulated to control fracture closure and proppant immobilization. During hydraulic stimulation treatments, a slurry mixture of water, chemicals, and proppant are injected. As fluid flows through a propagating fracture, various forces control the rate of proppant settling. Fracture conductivity is influenced significantly by how evenly proppant is distributed within the fracture after pumping stops. Proppant immobilization largely depends on a competition between the rate of fracture closure and the rate of proppant settling. The fracture may close once the fluid pressure drops below the normal stress acting on the fracture. The flow rates and pressures in the two wellbores are controlled to effectively drop the pressure in the fracture to rapidly close the fracture, ensuring the proppant is immobilized before proppant settling becomes significant and encouraging even distribution of proppant within the fracture. These newly created fractures, and proppant distribution, near the producing well increase conductivity of the reservoir with the production well and thus increase production from that well.

In an example, fractures initiating at one well are detected and characterized as they approach an adjacent well using distributed sensing optical fibers installed in the adjacent well. As fractures deform and propagate, they perturb the surrounding material. The length-scale over which stress and deformation perturbations is proportional to the dimension of the fracture, which grows larger throughout a stimulation treatment. Distributed acoustic sensing, distributed temperature sensing, and distributed strain sensing fiber optic cables may be installed in the adjacent well. Fluid pressure and temperature are also monitored in the adjacent well. These measurements combined are used to interpret where and when fractures that initiated at the first well approach the adjacent well. Properties such as fracture length, fracture width, rate of propagation, fracture spacing, and perforation/cluster efficiency can be interpreted. This information is used to adjust the stimulation treatment parameters, such as flow rate and proppant concentration, in the first well. In this manner these newly created fractures, and proppant distribution, near the producing well increase conductivity of the reservoir with the production well and thus increase production from that well.

The first or stimulation well may be a depleted production well, or a new well drilled solely for the purpose of stimulating a second well, e.g., the producing well. One stimulation well may be used to enhance the fracture pattern of one, two, three or more production wells that are adjacent to the stimulation well. By adjacent it is meant that the stimulation well is in the same general location or field as the well, or well, from which increased production is sought. It being understood that there can be one or more other wells between the stimulation well and the production well.

Figure 2:
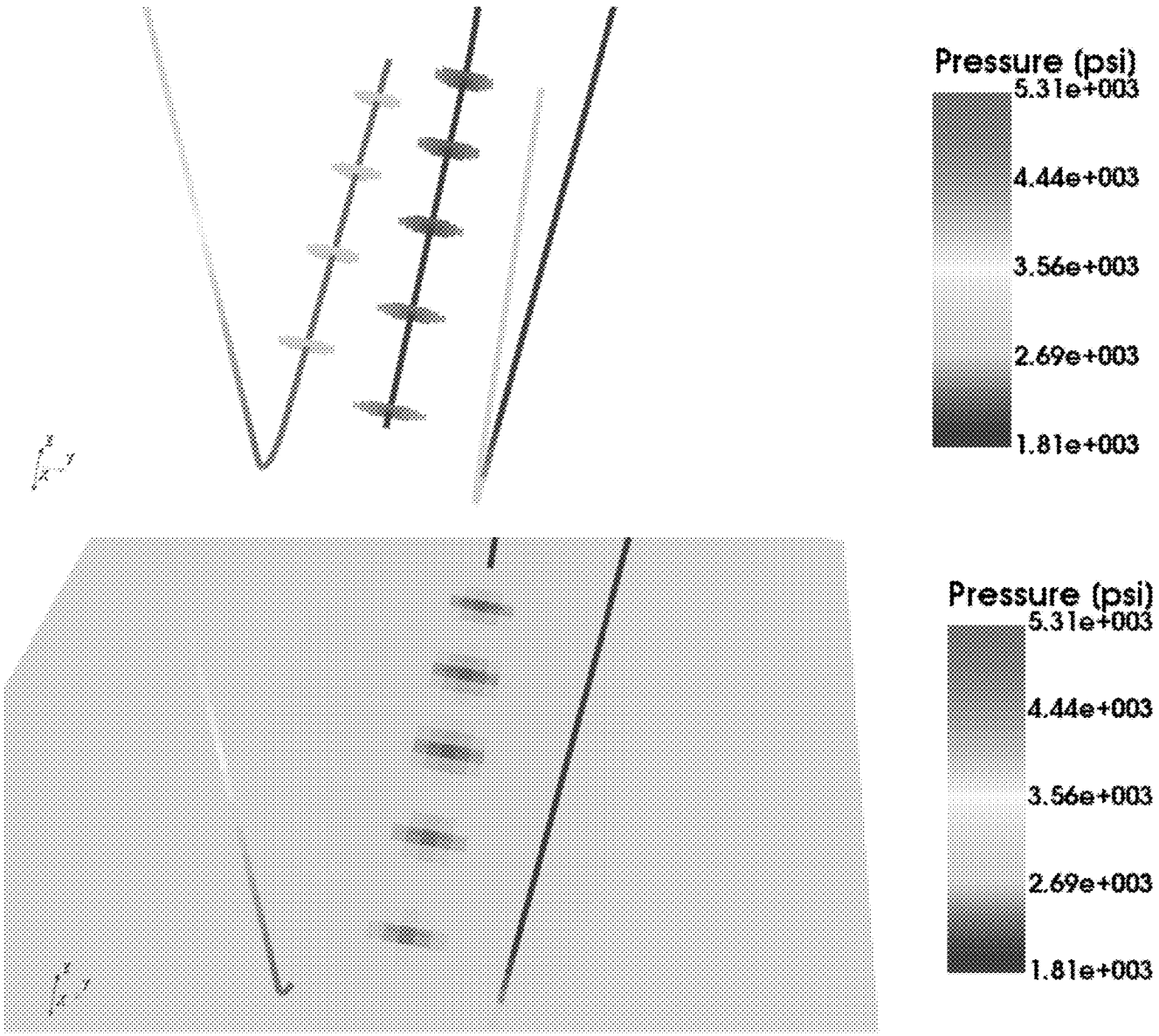
FIGS. 2-4 illustrate distributions of reservoir pressure in accordance with examples described herein.
Figure 3:
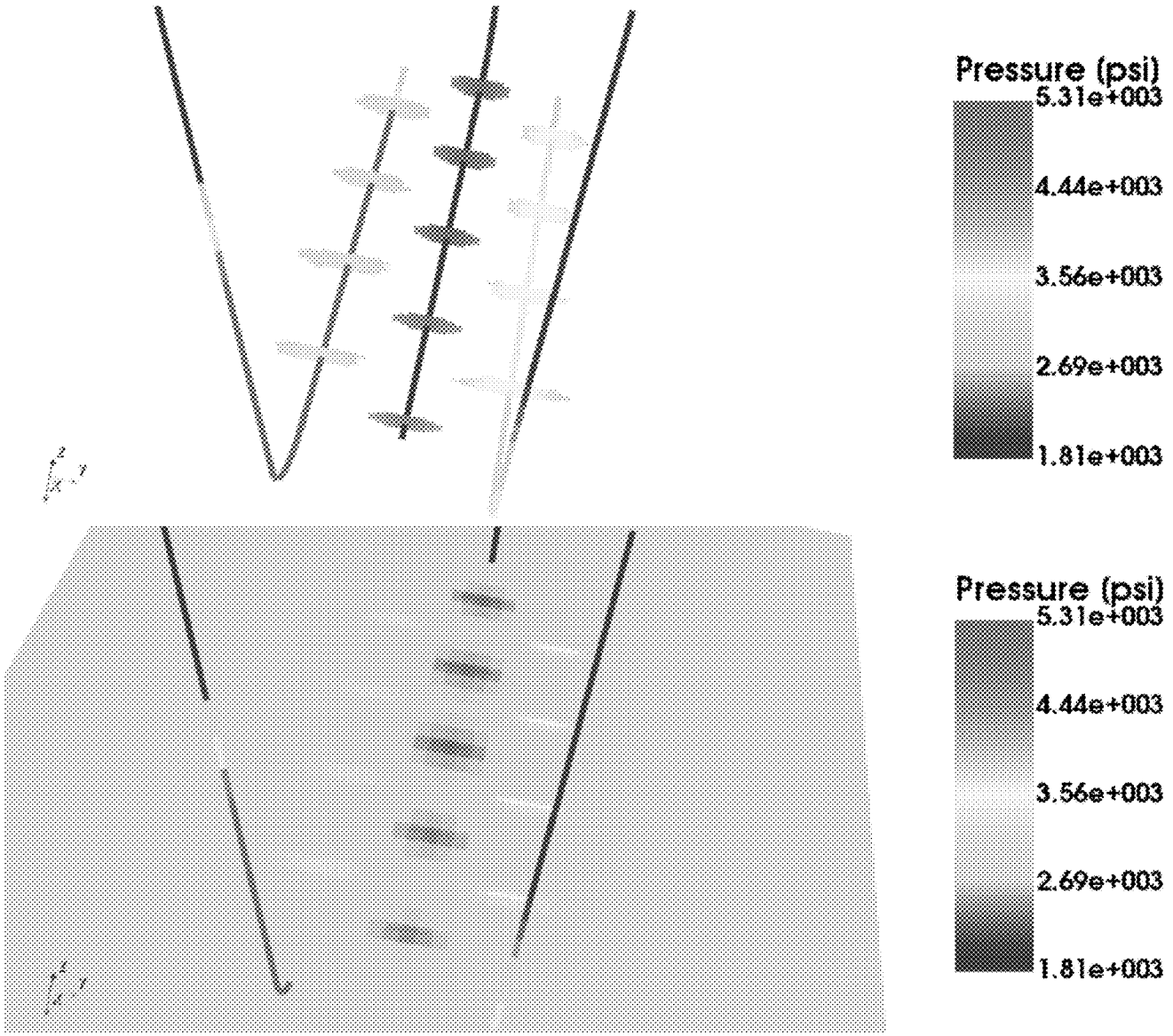
Figure 4:
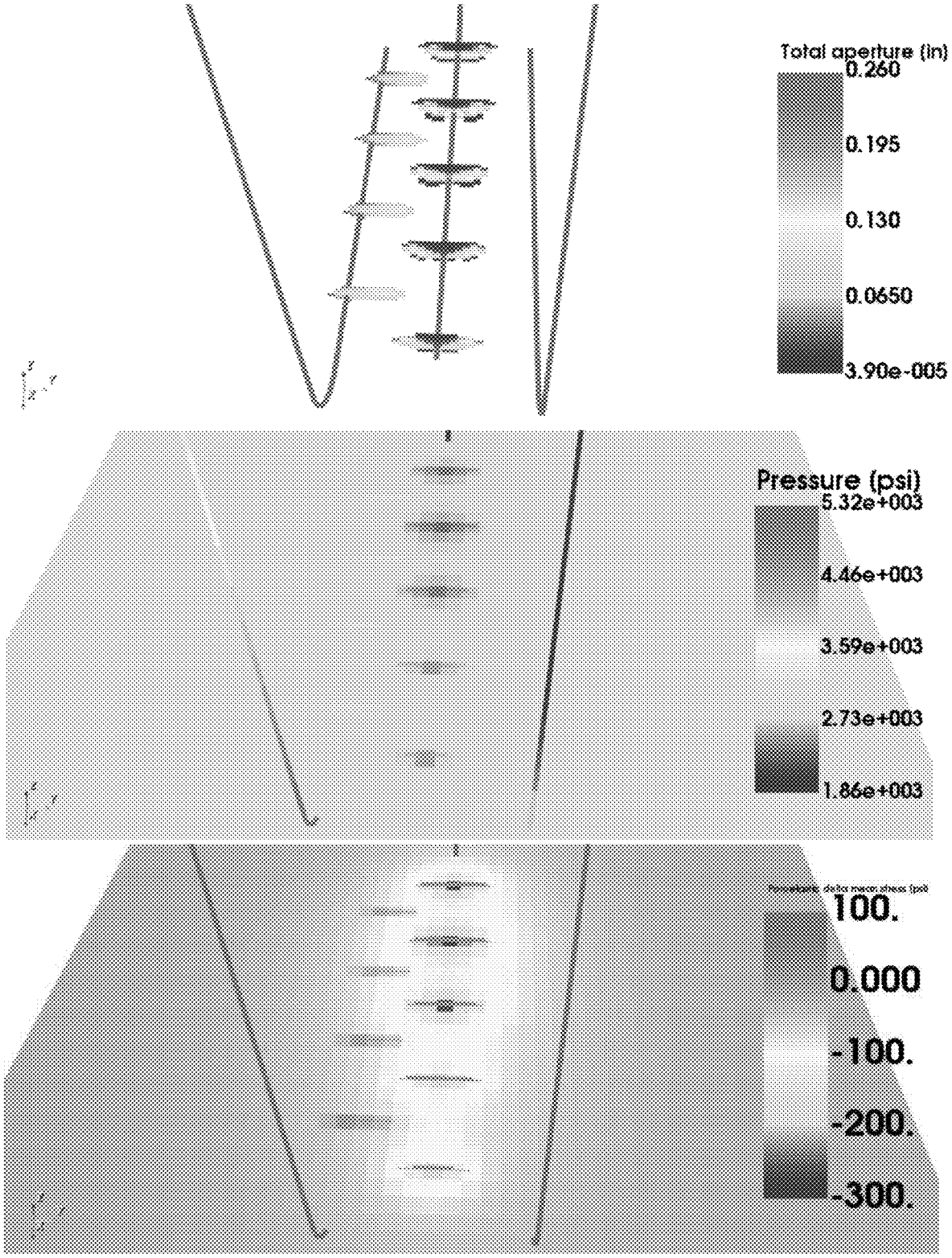

FIGS. 2-4 illustrate distributions of reservoir pressure in accordance with examples described herein.

FIG. 2 illustrates a distribution of reservoir pressure following one year of water production from the middle well (lower) and a snapshot of fracture geometry during hydraulic stimulation of the left well (upper). In this simulation, the poroelastic stress effect caused by pressure depletion was neglected, therefore the fractures tend to propagate uniformly and symmetrically.

FIG. 3 illustrates a distribution of reservoir pressure following one year of water production from the middle well (lower) and a snapshot of fracture geometry during hydraulic stimulation of the right well (upper). In this simulation, the poroelastic stress effect caused by pressure depletion was neglected, therefore the fractures tend to propagate uniformly and symmetrically.

FIG. 4 illustrates a distribution of reservoir pressure (middle) and the change in the mean normal stress caused by poroelastic effects (lower) following one year of water production from the middle well (lower), as well as a snapshot of fracture geometry during hydraulic stimulation of the left well (upper). In this simulation, the pressure depletion caused a poroelastic stress change that resulted in a reduction of the principal stresses. Therefore, the fractures in the offset well are encouraged to propagate into the low-stress zones near the middle well.

Figure 5:
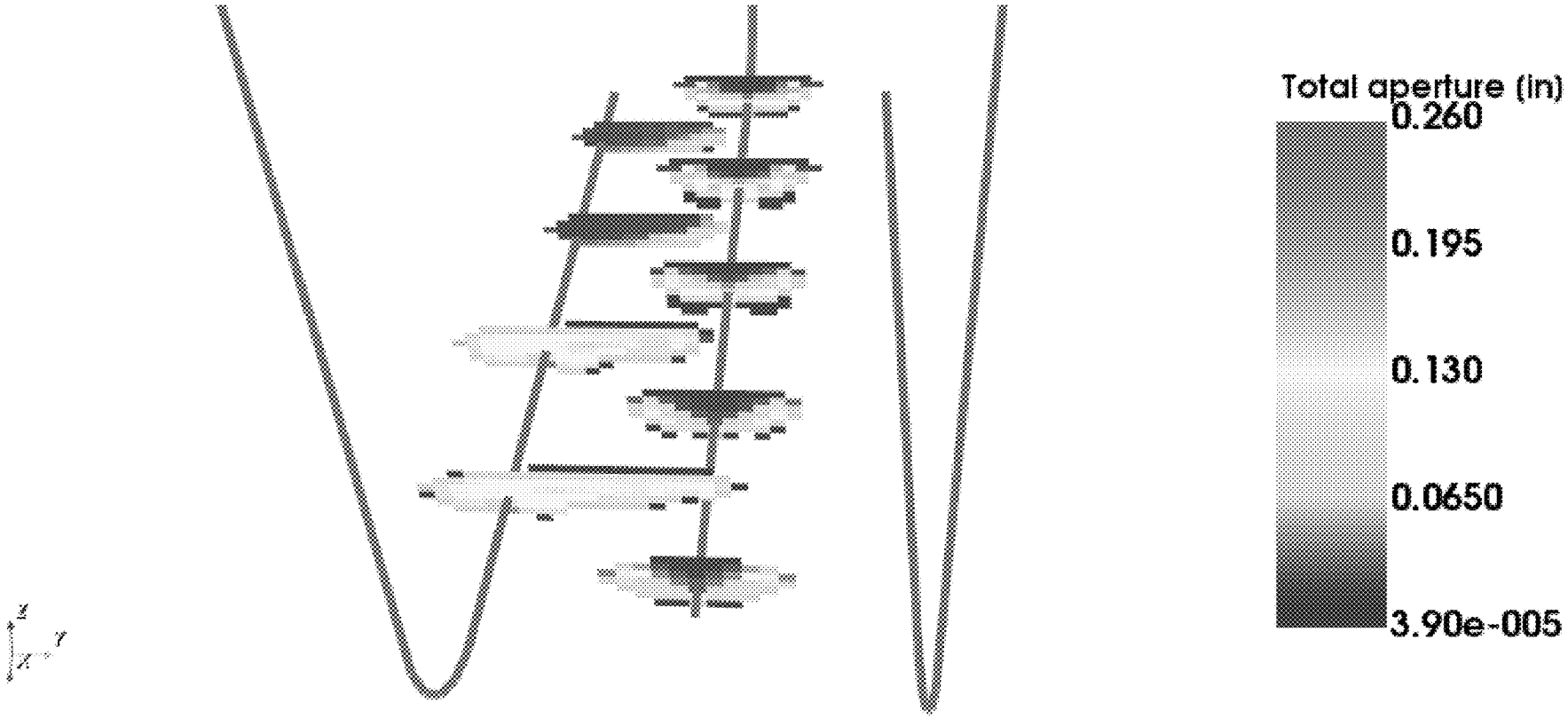
FIGS. 5-6 illustrate fracture geometry snapshots in accordance with examples described herein.
Figure 6:
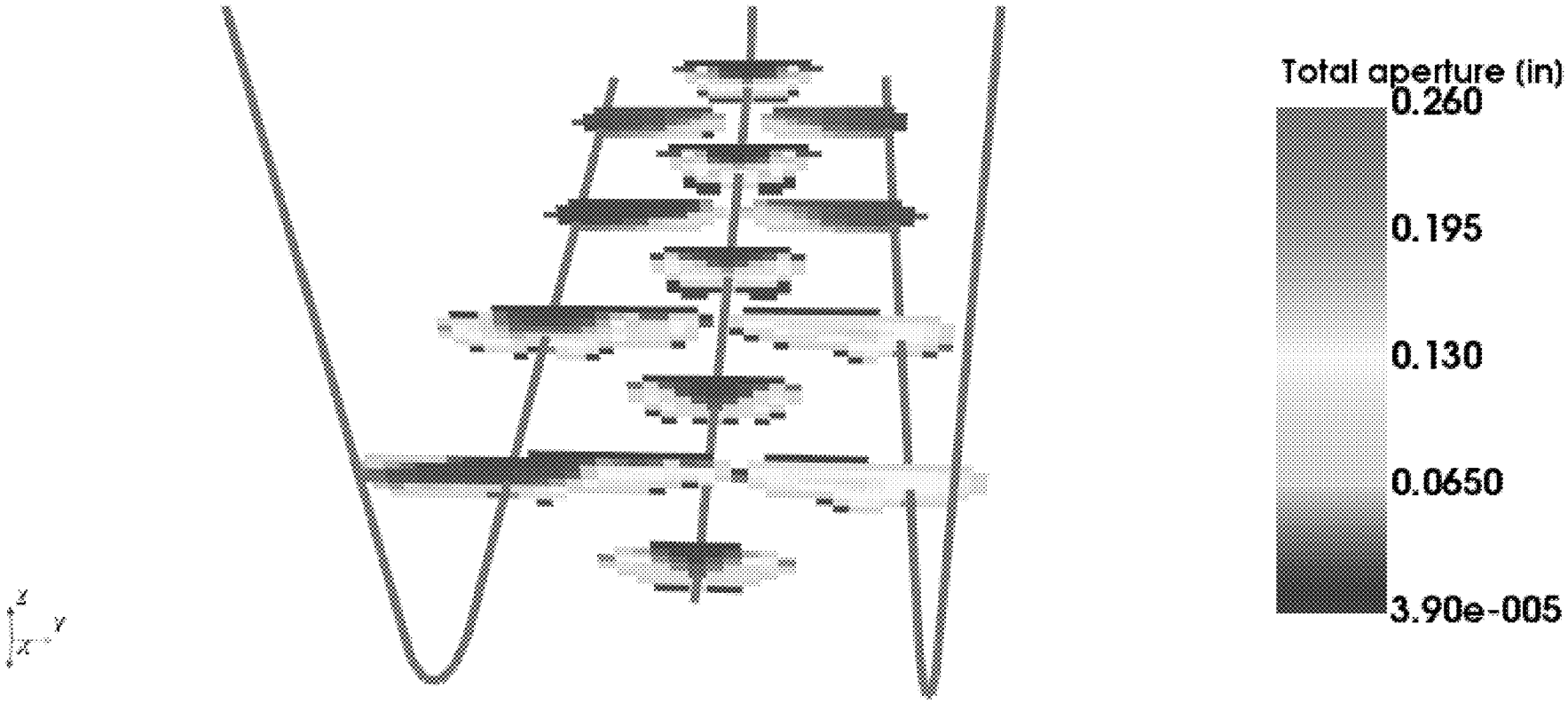

FIGS. 5-6 illustrate fracture geometry snapshots in accordance with examples described herein. FIG. 5 illustrates a snapshot of fracture geometry during hydraulic stimulation of the left well at a slightly later time than shown in FIG. 3. At this point, one of the fractures has effectively intersected the middle well creating a hydraulic connection. FIG. 6 illustrates a snapshot of fracture geometry during hydraulic stimulation of the right well. Fracture growth occurs toward the middle well due to poroelastic effects related to pressure drawdown. At this point, one of the fractures has effectively intersected the middle well creating a hydraulic connection.

Figure 7:
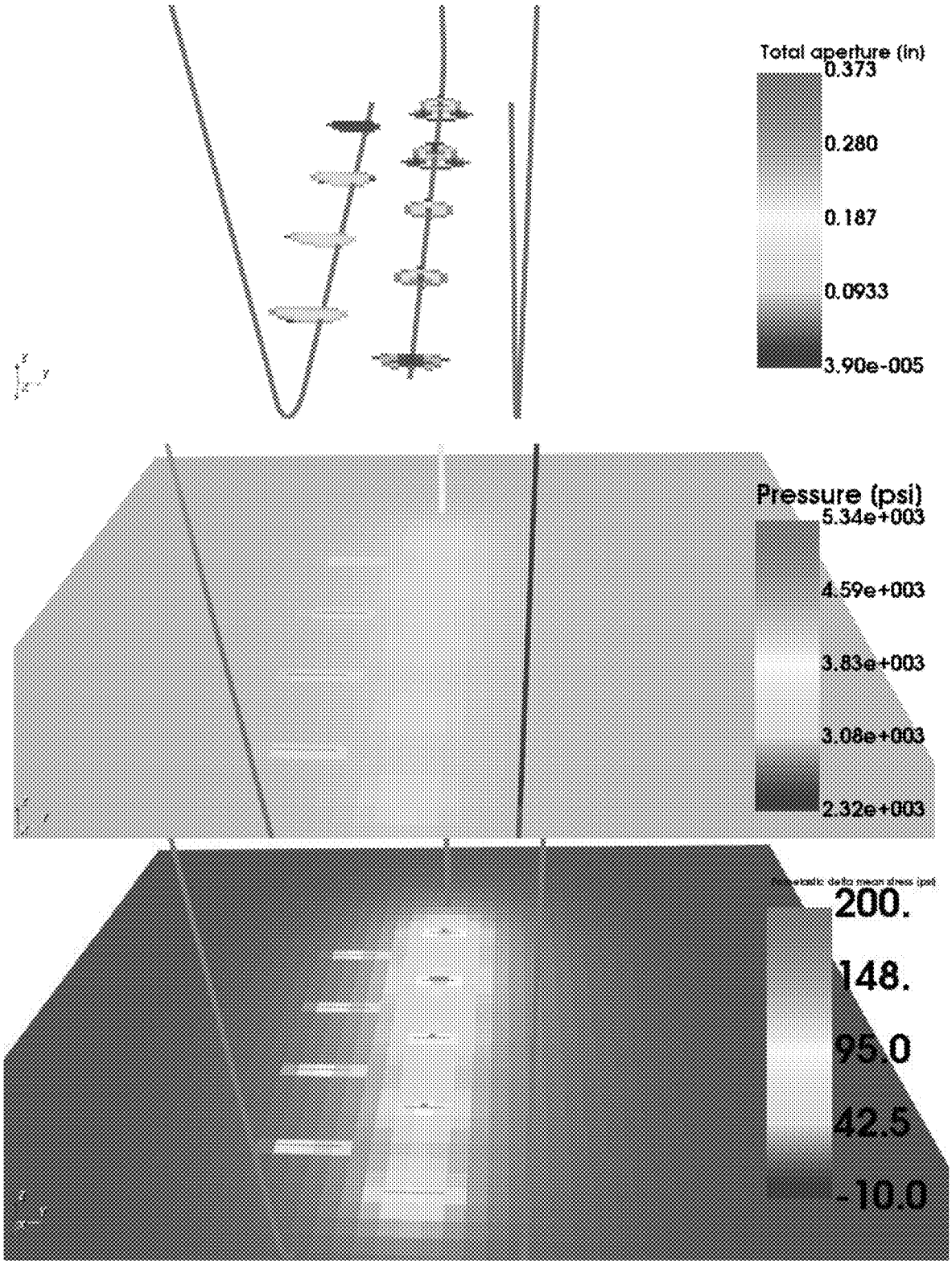
FIG. 7 illustrates a distribution of reservoir pressure in accordance with examples described herein.

FIG. 7 illustrates a distribution of reservoir pressure in accordance with examples described herein. The distribution of reservoir pressure (middle) and the change in the mean normal stress is caused by poroelastic effects (lower) following one year of water injection into the middle well (lower). Also shown is a snapshot of fracture geometry during hydraulic stimulation of the left well (upper). In this simulation, the fluid injection caused a poroelastic stress change that resulted in an increase in the principal stresses. Therefore, the fractures in the offset well are encouraged to propagate away from the high-stress zones near the middle well.

Figure 8:
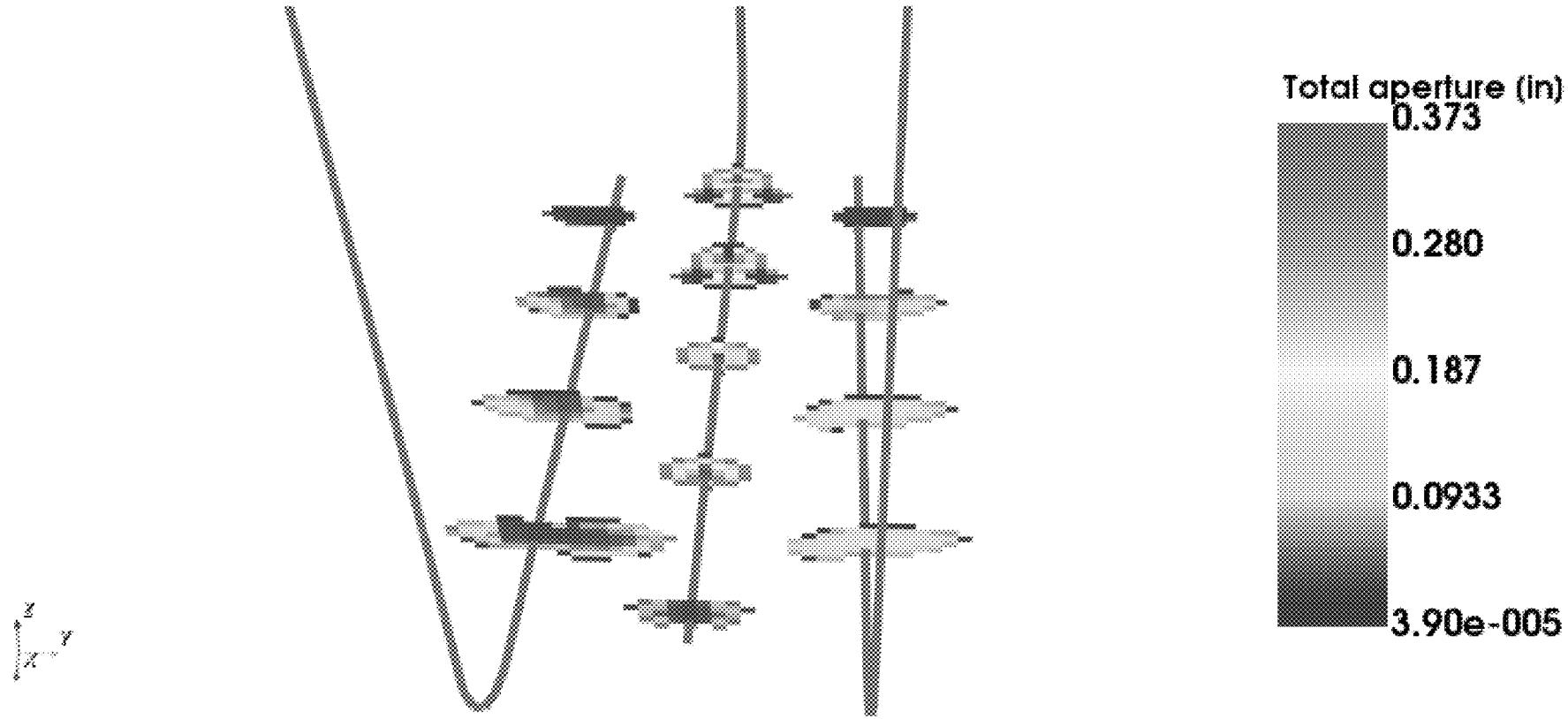
FIG. 8 illustrates a fracture geometry snapshot in accordance with examples described herein.

FIG. 8 illustrates a fracture geometry snapshot in accordance with examples described herein. The snapshot is of fracture growth during hydraulic stimulation in offset wells near a region of increased stress caused by poroelastic effects. The fractures grown in a relatively complex shapes due to the poroelastic effects, which may promote interaction with preexisting fractures, increasing fracture connectivity.

Figure 9A:
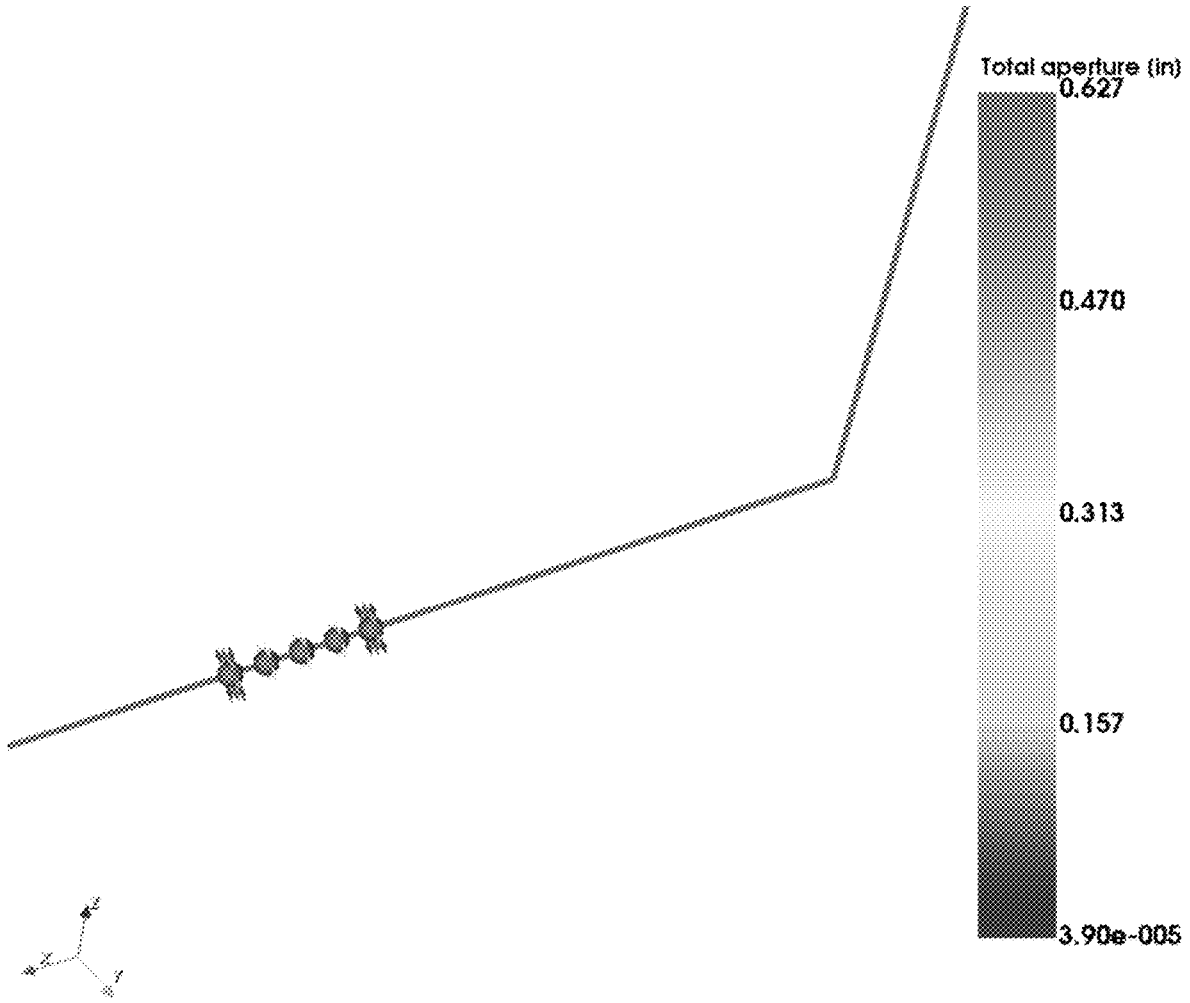
FIGS. 9A-9C illustrate fracture growth during a multicluster hydraulic stimulation treatment in accordance with examples described herein.
Figure 9B:
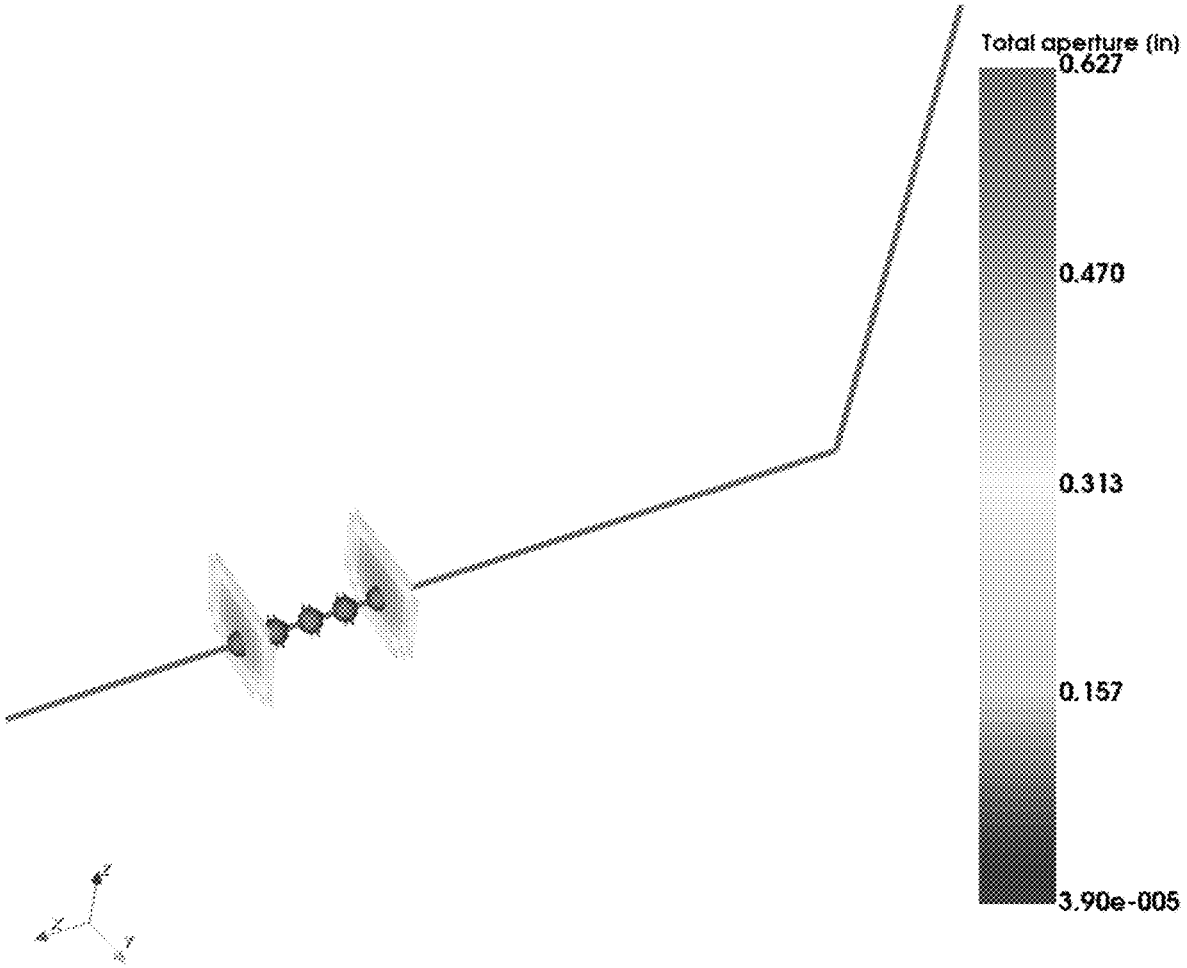
Figure 9C:
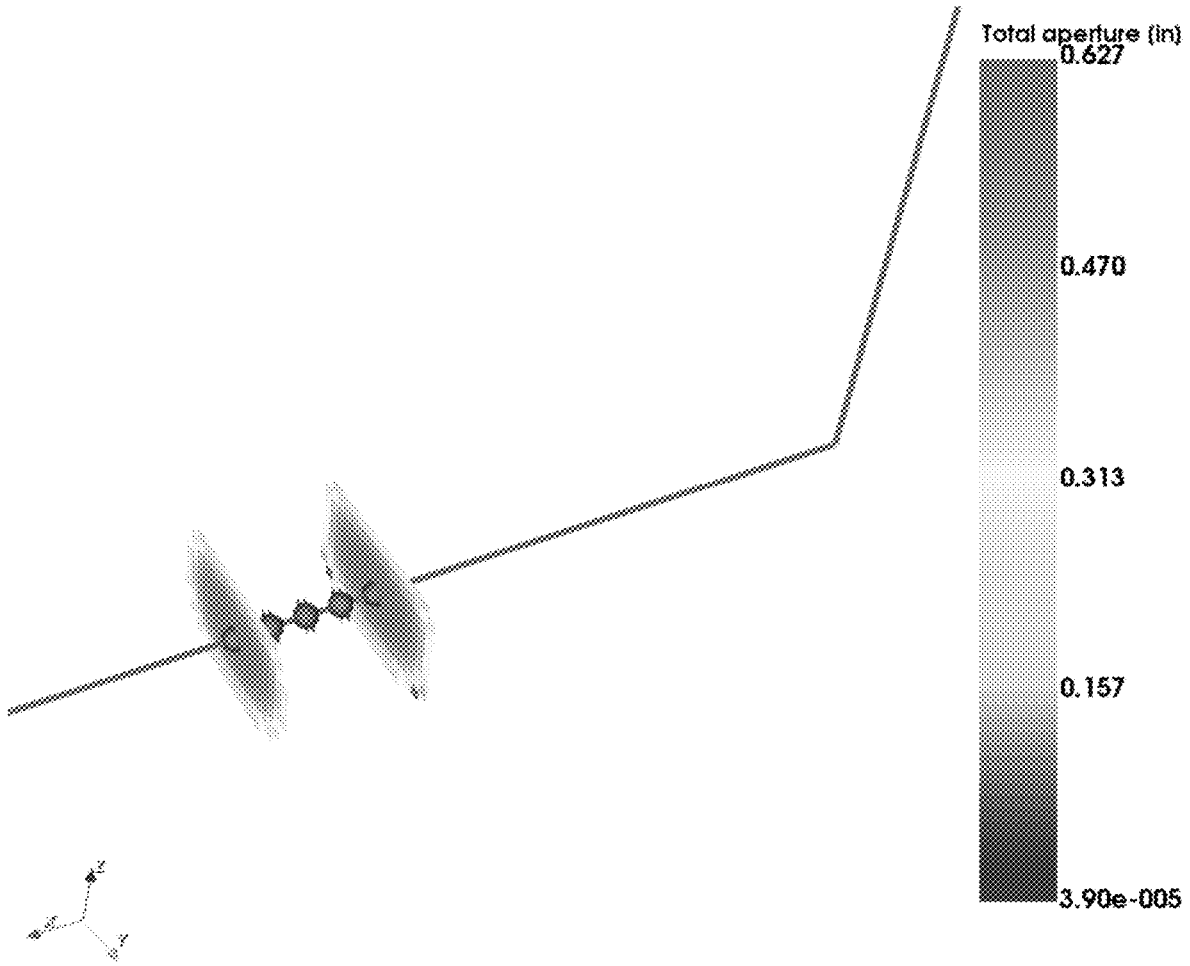

FIGS. 9A-9C illustrate fracture growth during a multicluster hydraulic stimulation treatment in accordance with examples described herein. The fracture growth is shown for a multicluster hydraulic stimulation treatment with five clusters per stage. In this example, the middle three fractures screen out and stop taking fluid early in the treatment, resulting in an ineffective distribution of fracture permeability. The upper left, upper right, and lower middle images correspond to 0.08 hours, 0.63 hours, and 1.46 hours of injection, respectively.

Figure 10A:
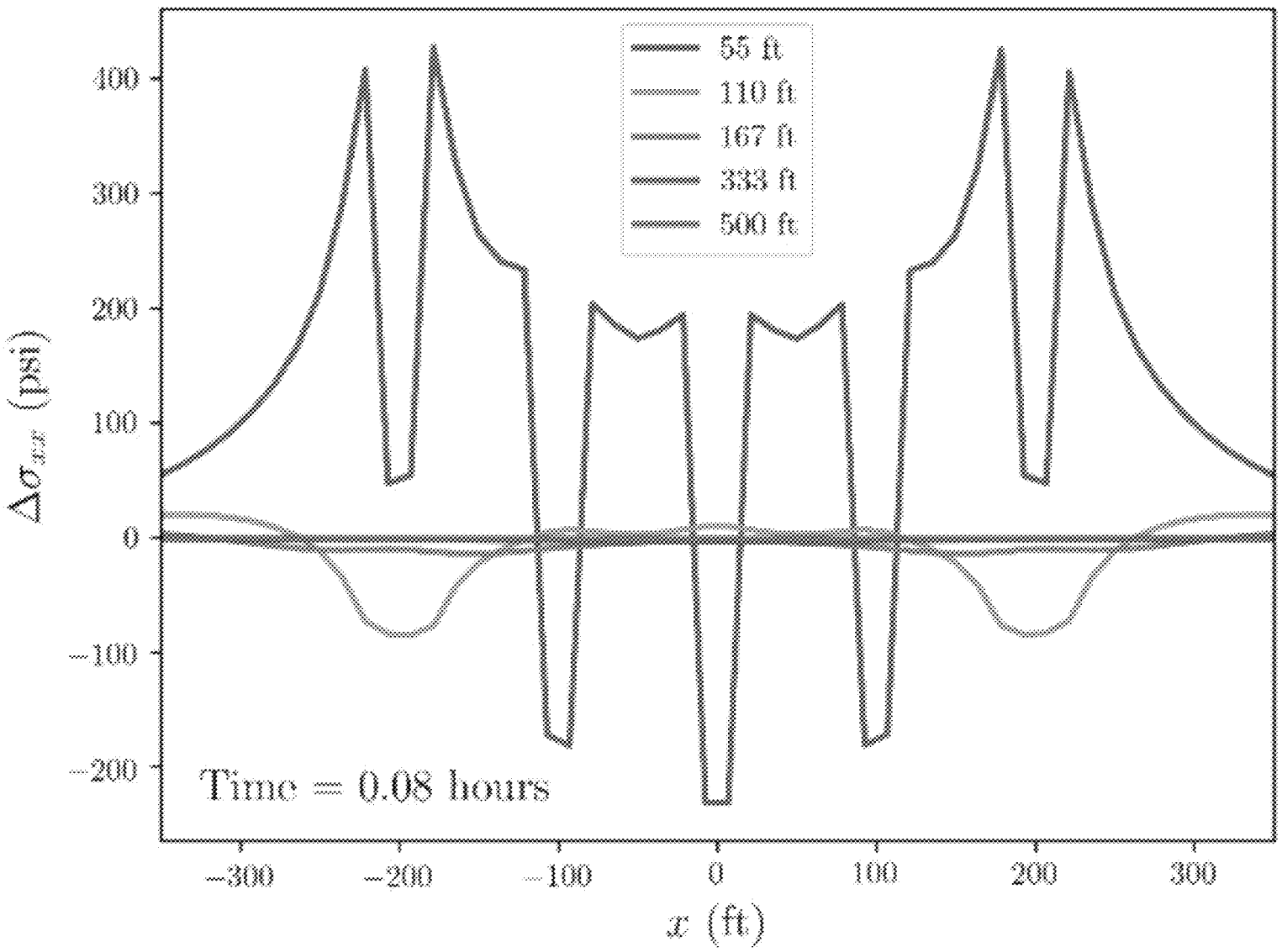
FIGS. 10A-10C illustrate a simulated elastic response of rock along profiles parallel to a simulated well in accordance with examples described herein.
Figure 10B:
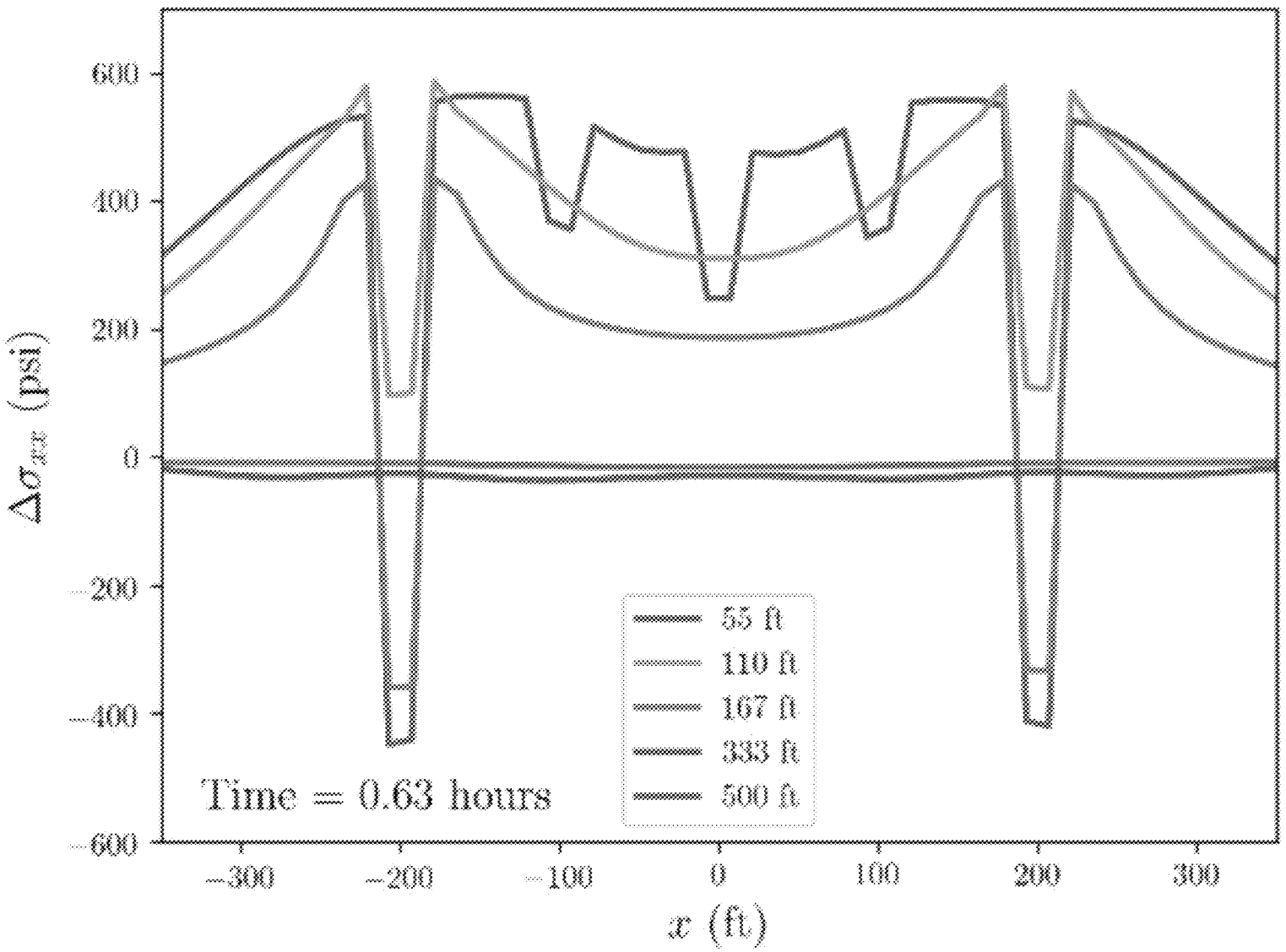
Figure 10C:
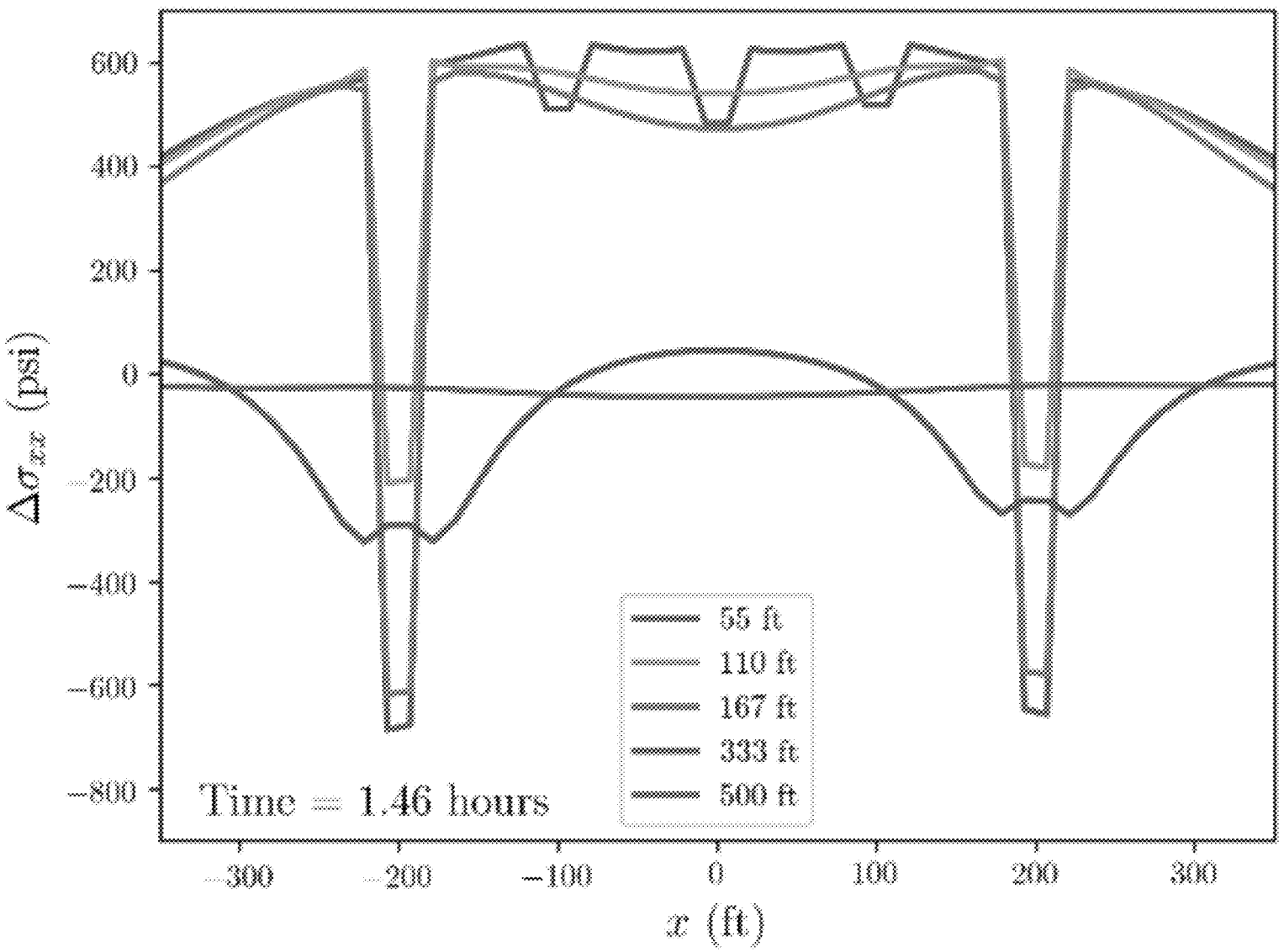

FIGS. 10A-10C illustrate a simulated elastic response of rock along profiles parallel to a simulated well in accordance with examples described herein. FIGS. 10A-10C includes a simulated elastic response of the rock along profiles parallel to the stimulated well (referenced in FIGS. 9A-9C) representing the response of a Distributed Strain Sensing (DSS) fiber optic cable in an offset well. The different lines represent various offset well spacings. The elastic response clearly indicates that the two outermost fractures are growing overtime, whereas the middle three fractures stopped growing early in the treatment. The signal is detectable at distances of over 300 ft away from the stimulated well.

Figure 11A:
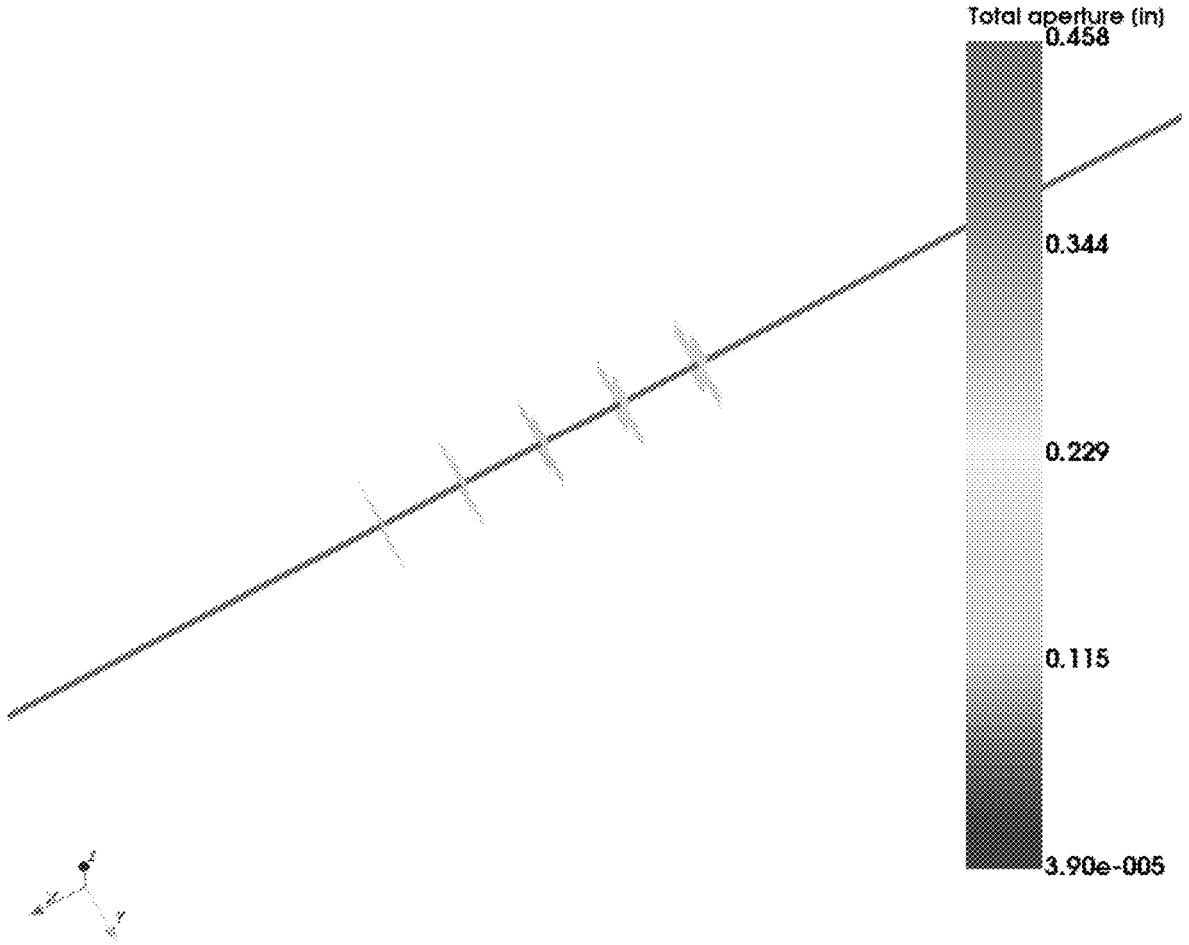
FIGS. 11A-11C illustrate fracture growth during a multicluster hydraulic stimulation treatment in accordance with examples described herein.
Figure 11B:
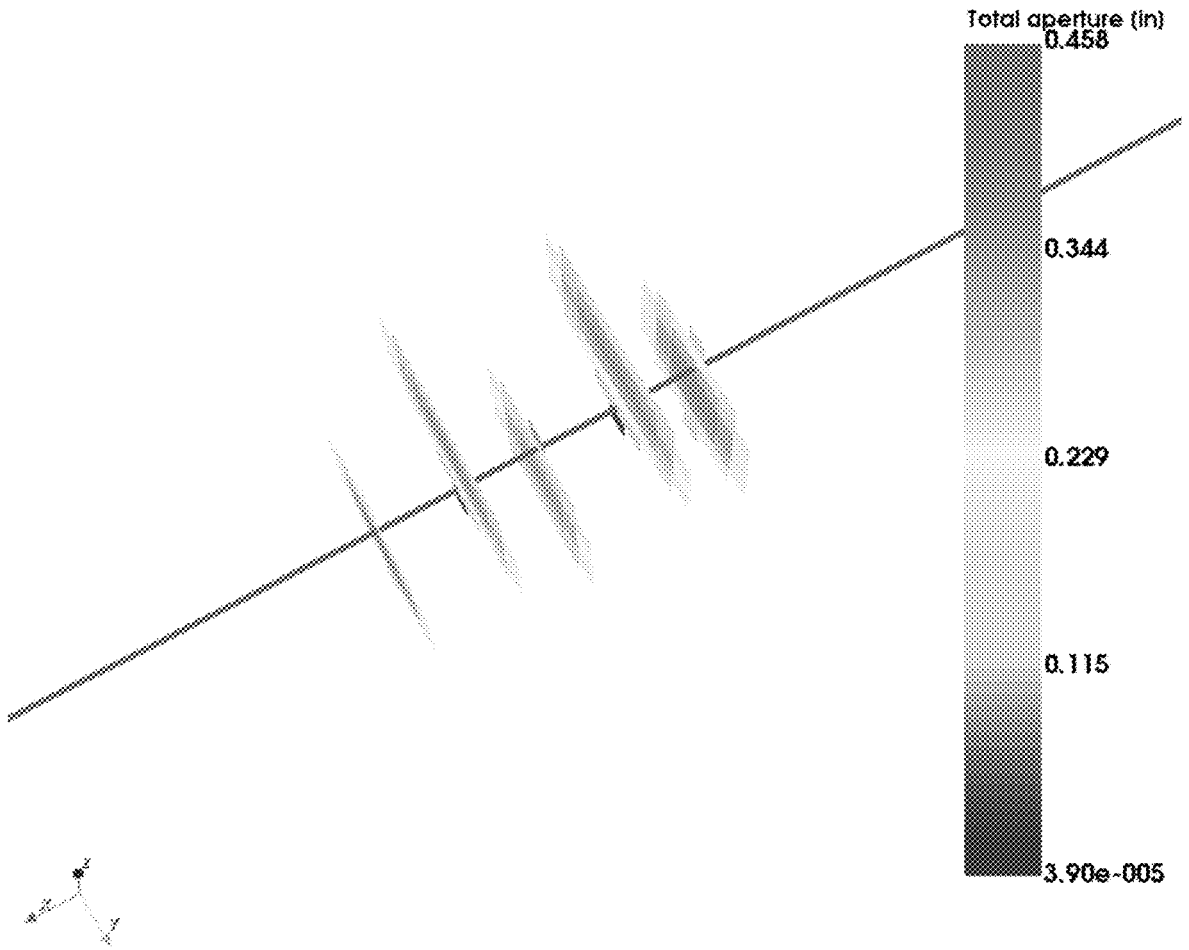
Figure 11C:
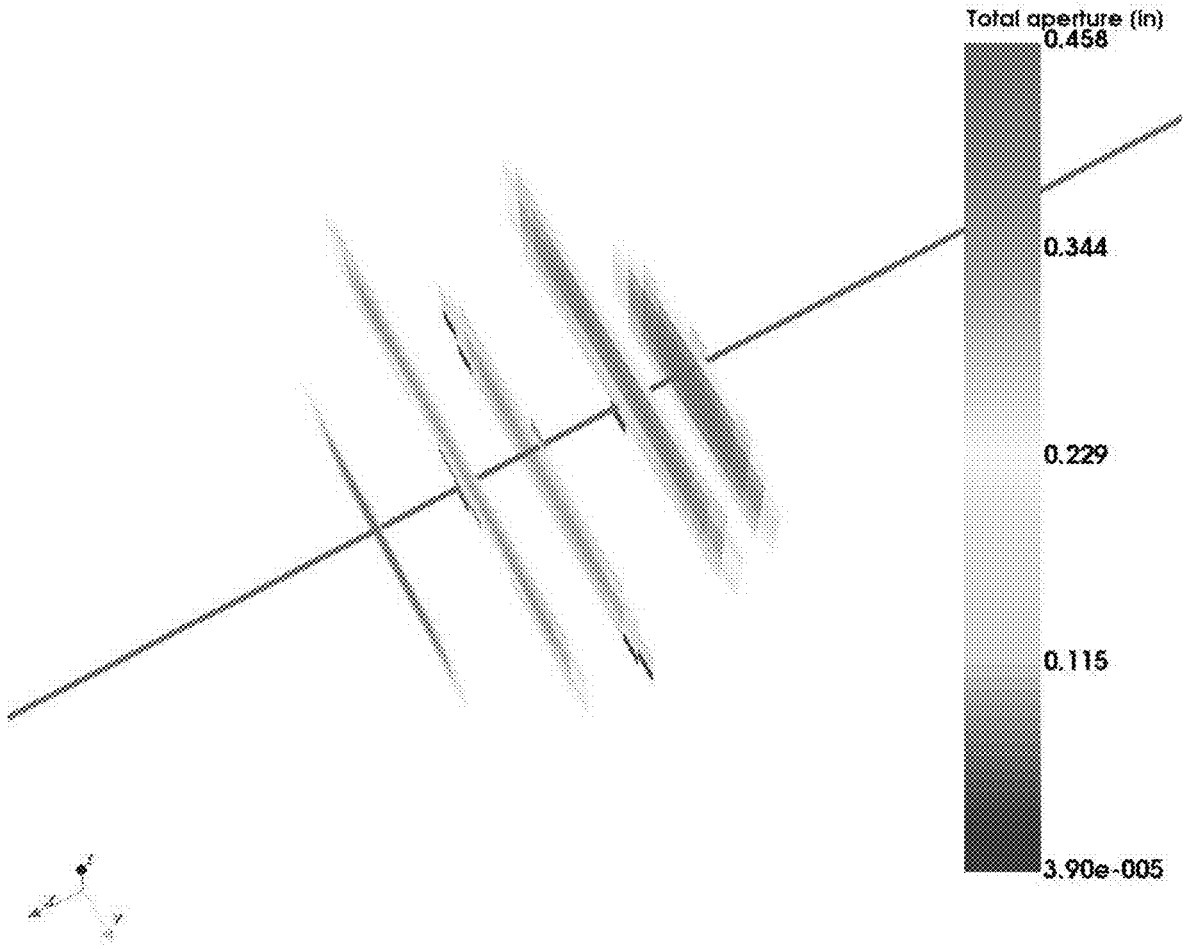

FIGS. 11A-11C illustrate fracture growth during a multicluster hydraulic stimulation treatment in accordance with examples described herein. Fracture growth is shown during a multicluster hydraulic stimulation treatment with five clusters per stage. In this case, no fractures screen out and fracture propagation occurs relatively uniformly. The upper left, upper right, and lower middle images correspond to 0.05 hours, 0.61 hours, and 1.46 hours of injection, respectively.

Figure 12A:
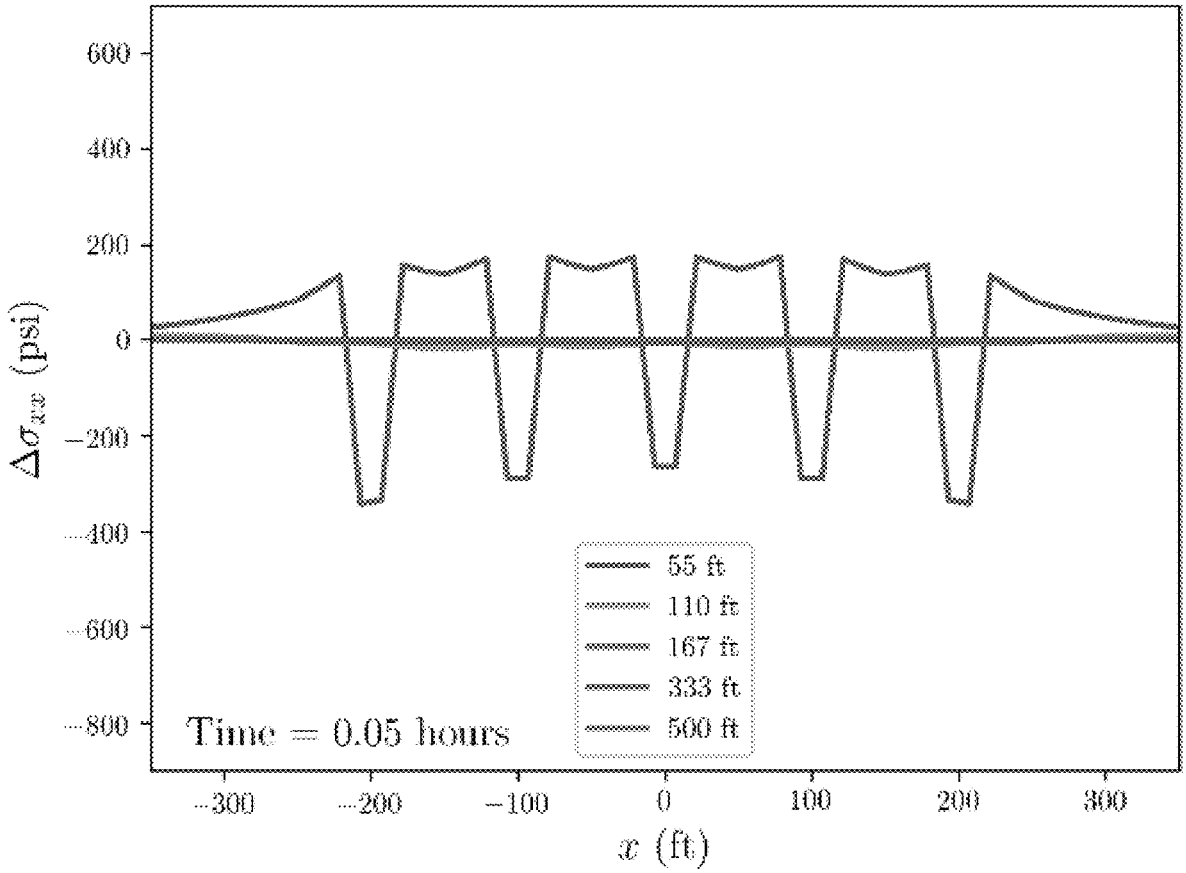
FIGS. 12A-12C illustrate a simulated elastic response of rock along profiles parallel to a simulated well in accordance with examples described herein.
Figure 12B:
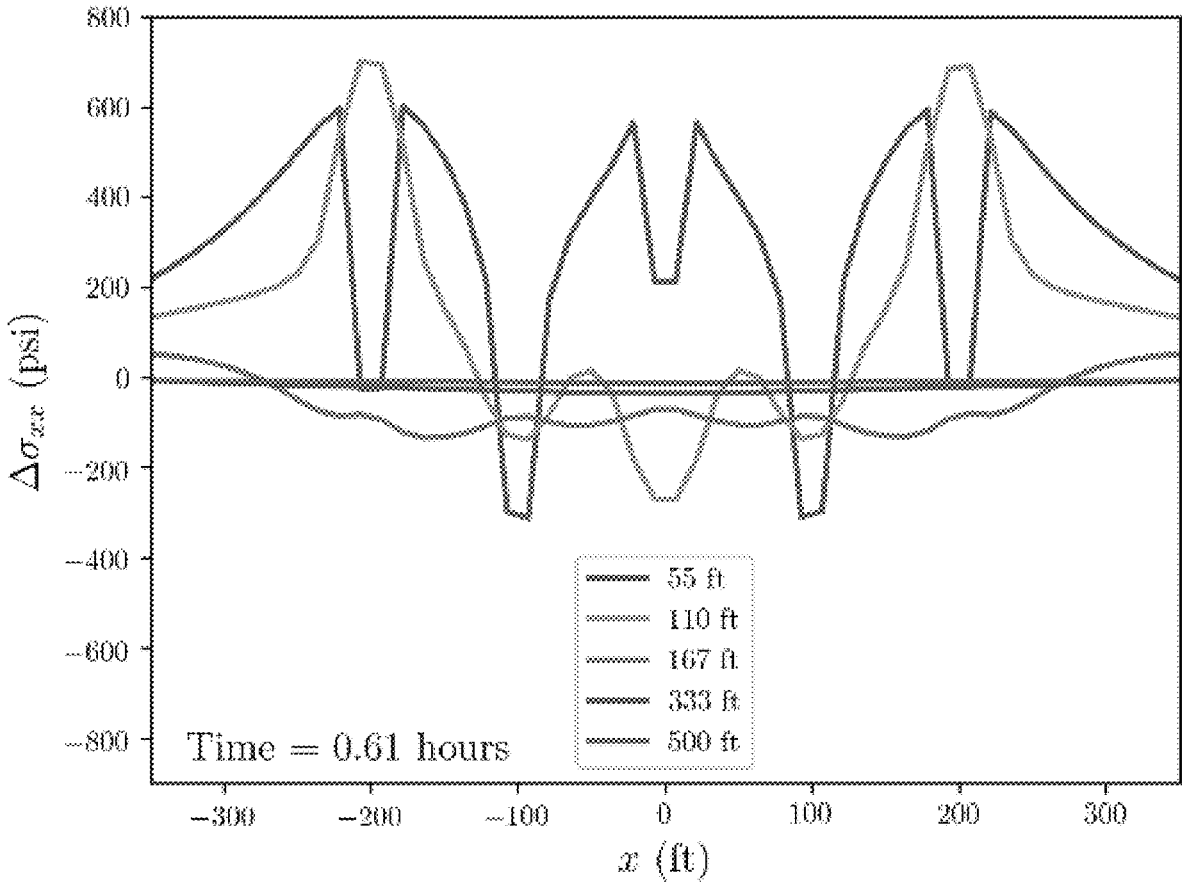
Figure 12C:
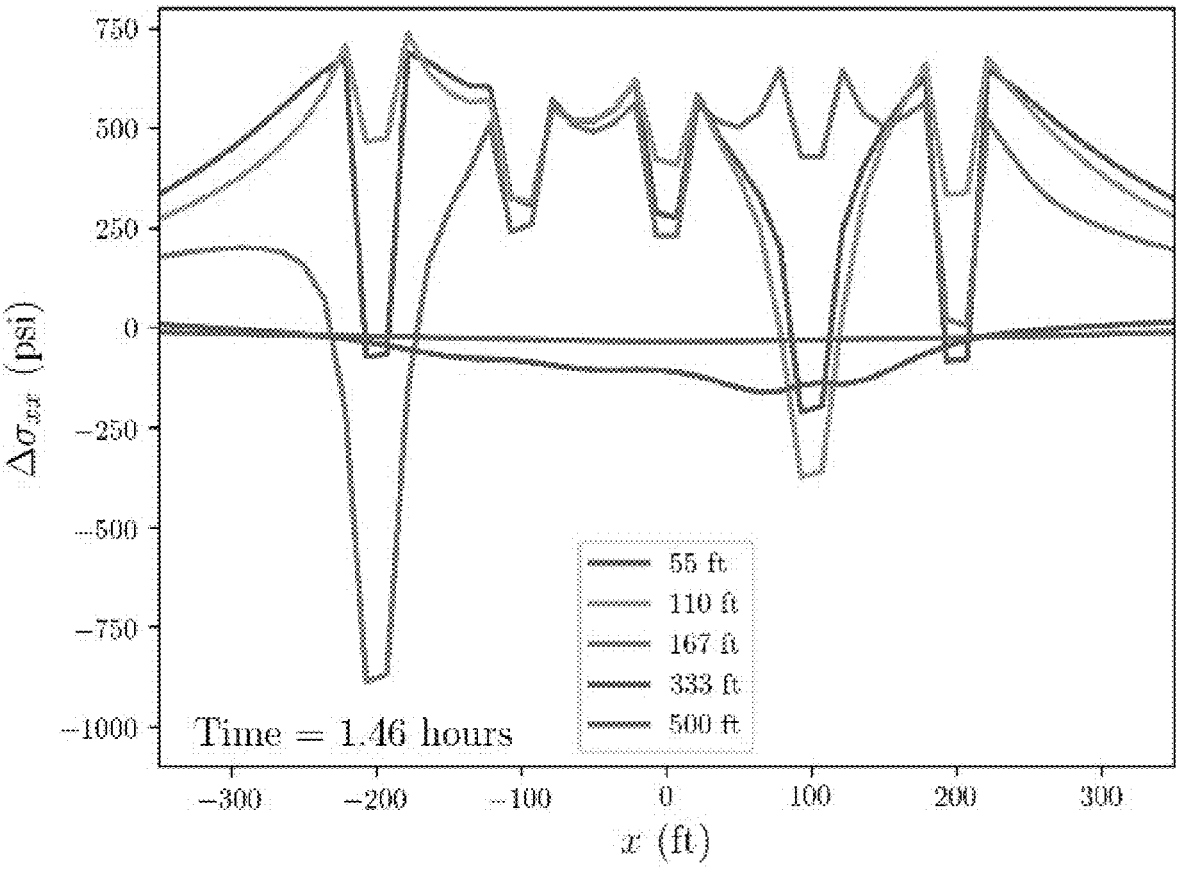

FIGS. 12A-12C illustrate a simulated elastic response of rock along profiles parallel to a simulated well in accordance with examples described herein. FIGS. 12A-12C shows simulated elastic response of the rock along profiles parallel to the stimulated well (referenced in FIGS. 11A-11C) representing the response of a Distributed Strain Sensing (DSS) fiber optic cable in an offset well. The different lines represent various offset well spacings. The elastic response clearly indicates that the fractures begin propagating relatively uniformly at early times. At later times, heterogeneity in fracture propagation is observed. The signal is detectable at distances of over 300 ft away from the stimulated well.

Figure 13:
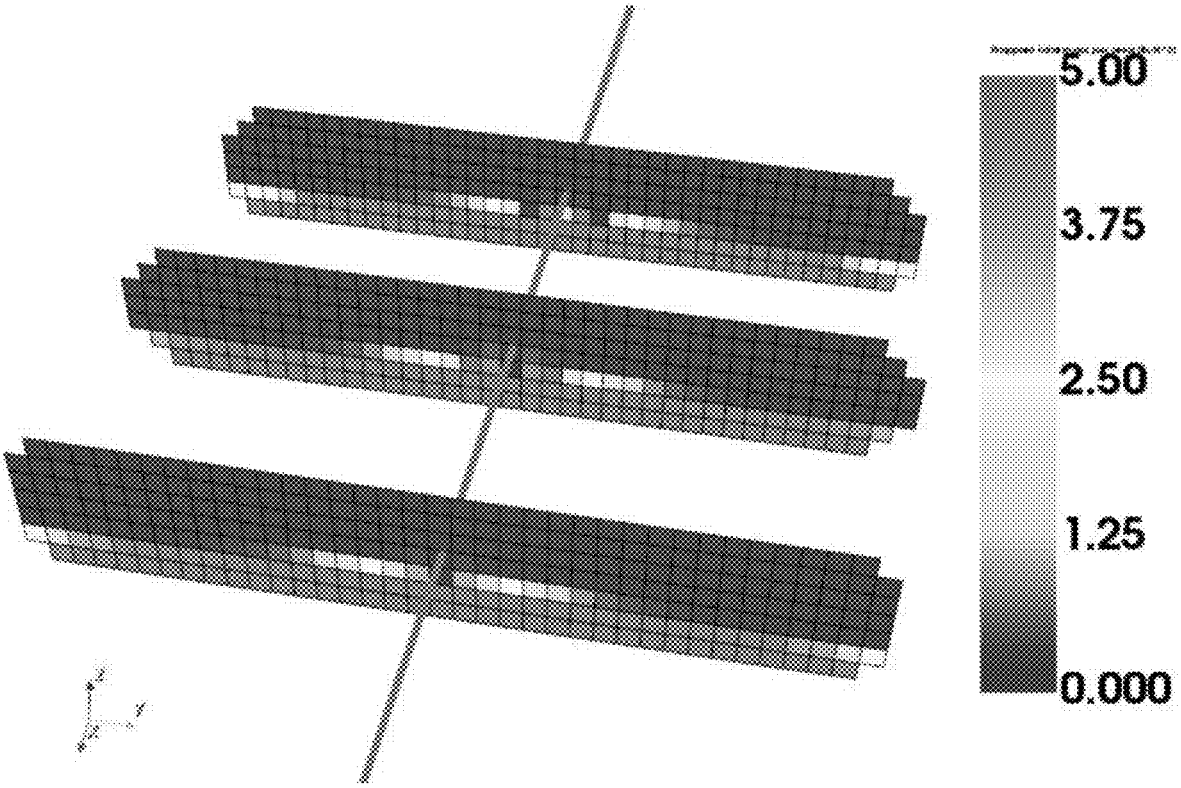
FIGS. 13-14 illustrate distributions of proppant concentration at an end of a multicluster stimulation treatment in accordance with examples described herein.
Figure 14:
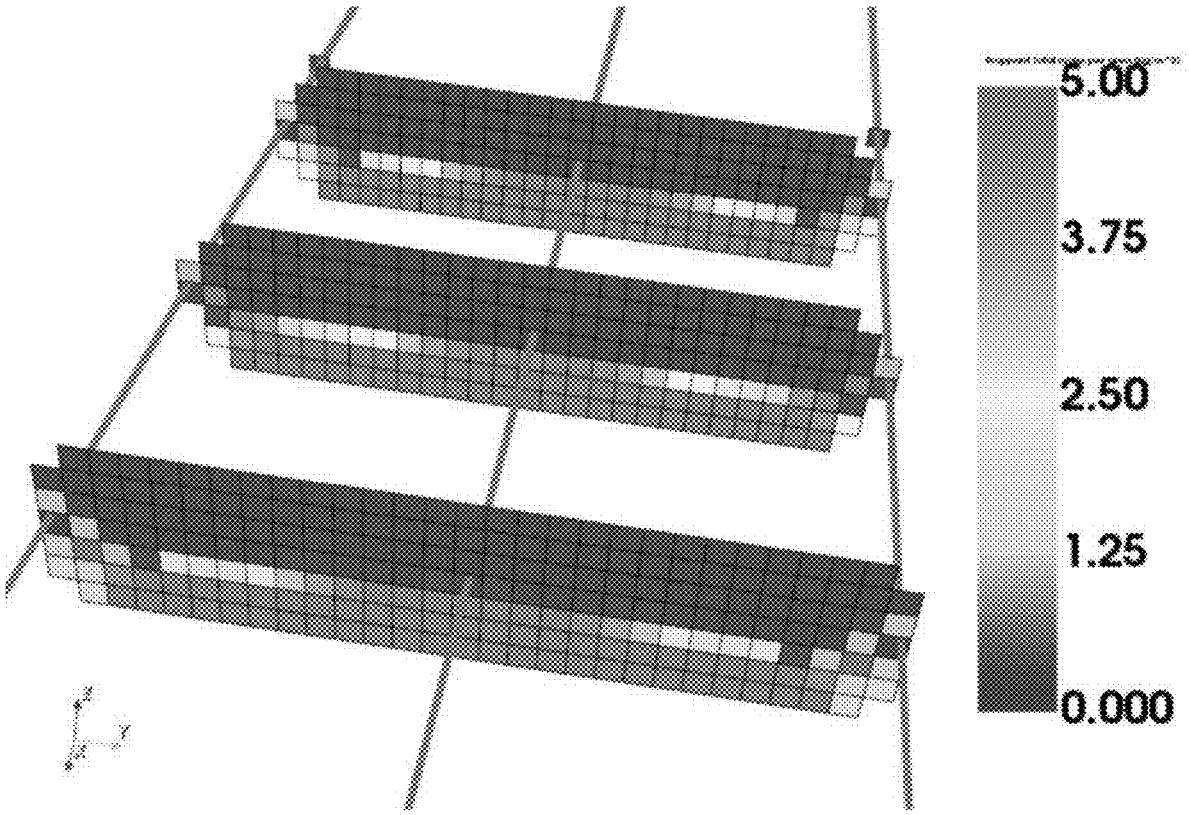

FIGS. 13-14 illustrate distributions of proppant concentration at an end of a multicluster stimulation treatment in accordance with examples described herein. FIG. 13 shows a distribution of proppant concentration (measured as mass per fracture surface area) at the end of a multicluster stimulation treatment. FIG. 14 shows a distribution of proppant concentration (measured as mass per fracture surface area) at the end of a multicluster stimulation treatment. In this simulation, once the hydraulic fractures intersected the offset wells, fluid was produced from the offset wells causing the pressure in the fracture to decrease. This relatively fast fracture closure improved the distribution of proppant within the fracture.

Figure 15:
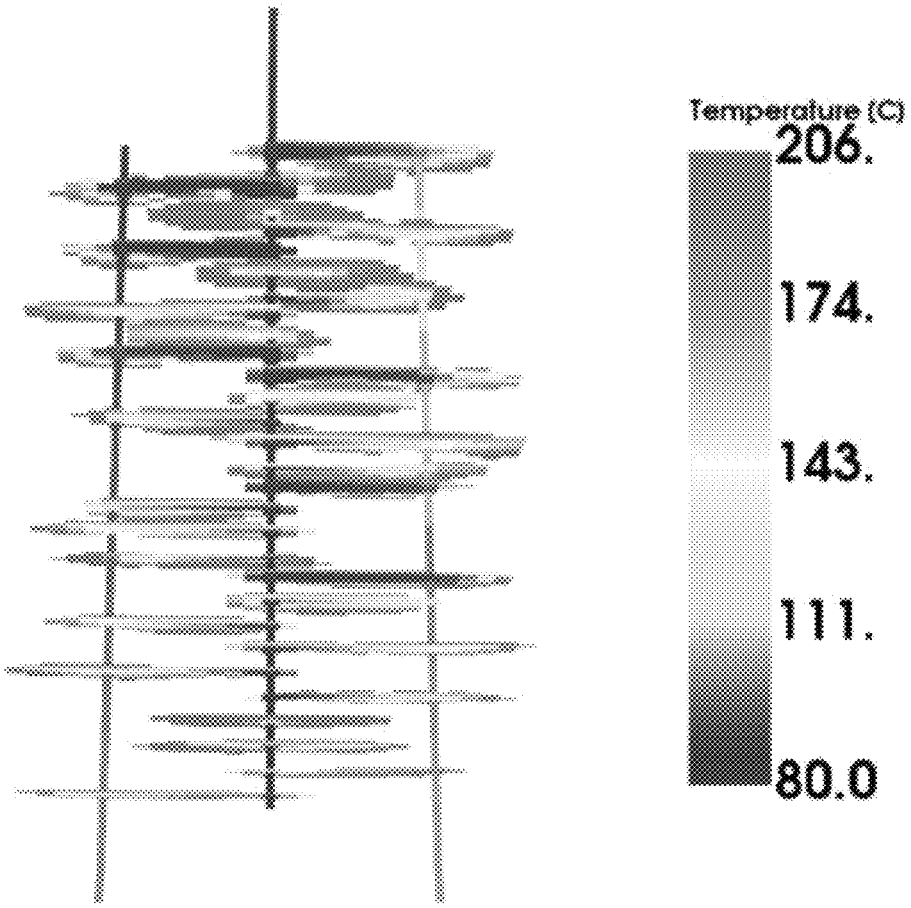
FIG. 15 illustrates simulation results including fracture geometry resulting from a multistage, multicluster hydraulic stimulation treatment in accordance with examples described herein.

FIG. 15 illustrates simulation results including fracture geometry resulting from a multistage, multicluster hydraulic stimulation treatment in accordance with examples described herein. FIG. 15 shows simulation results illustrating the fracture geometry resulting from a multistage, multicluster hydraulic stimulation treatment in the center well. The simulation considers the mechanically induced stress changes caused by fracture propagation and deformation (i.e., "stress shadowing" effects). The stress shadowing effects cause asymmetric fracture propagation away from the treatment well. These effects are taken advantage of in the reservoir engineering design to improve thermal sustainability of the resource.

Figure 16:
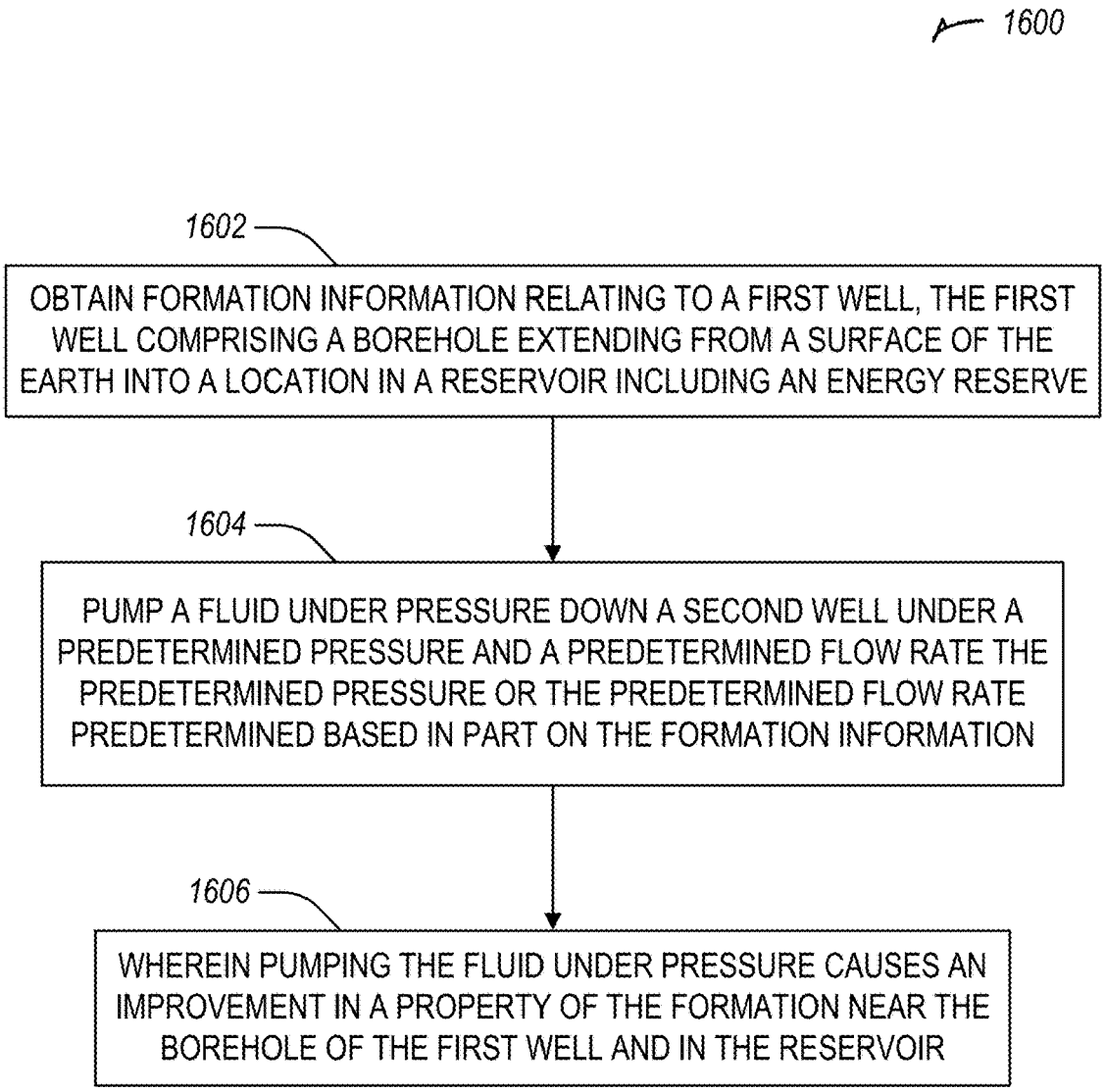
FIG. 16 illustrates an example technique for increasing recovery of a resource from the earth in accordance with examples described herein.

FIG. 16 illustrates an example technique 1600 for increasing recovery of a resource from the earth in accordance with examples described herein.

The technique 1600 includes an operation 1602 to obtain formation information relating to a first well, the first well comprising a borehole extending from a surface of the earth into a location in a reservoir including an energy reserve. In an example, the energy reserve comprises a source of geothermal energy. In this example, the second well may comprise a second borehole that extends into the earth, for example where the second borehole has a stimulation section located a distance from the location of the borehole, where the fluid is pumped out of the stimulation section into the formation. In other examples, the second borehole has a stimulation section, defined by a plug located at a depth below a perforation section. In another example, the energy reserve comprises a hydrocarbon. In this example, the second well may comprise a second borehole that extends into the earth, where the second borehole has a stimulation section located a distance from the location of the borehole, and the fluid is pump out of the stimulation section into the formation. In some examples, the second borehole has a stimulation section, defined by a plug located at a depth below a perforation section. In yet another example, the energy reserve comprises a crude oil. In this example, a second well may comprise a second borehole that extends into the earth, wherein the second borehole has a stimulation section located a distance from the location of the borehole, wherein the fluid is pump out of the stimulation section into the formation. In some examples, the second borehole has a stimulation section, defined by a plug located at a depth below a perforation section.

The technique 1600 includes an operation 1604 to pump a fluid under pressure down a second well under a predetermined pressure and a predetermined flow rate the predetermined pressure or the predetermined flow rate predetermined based in part on the formation information.

The technique 1600 includes an operation 1606 wherein pumping the fluid under pressure causes an improvement in a property of the formation near the borehole of the first well and in the reservoir.

In an example, the second well comprises a second borehole that extends into the earth. The second borehole may have a stimulation section located a distance from the location of the borehole. The fluid may be pumped out of the stimulation section into the formation. In this example, the stimulation section may be located a distance from the location of the borehole in the reservoir. The distance may include from about 20 feet to about 2,000 feet, for example, from about 100 feet to about 1,000 ft, less than about 2,000 ft, less than about 1,000 ft, or the like. The fluid may be pumped in a series of stages, such as stages having a first pressure and a second pressure that is different from the first pressure, for example. The stages may have a hold time. In an example, the second well comprises a second borehole that extends into the earth, wherein the second borehole has a stimulation section, defined by a plug located at a depth below a perforation section, wherein the fluid is pump out of the stimulation section into the formation.

Figure 17:
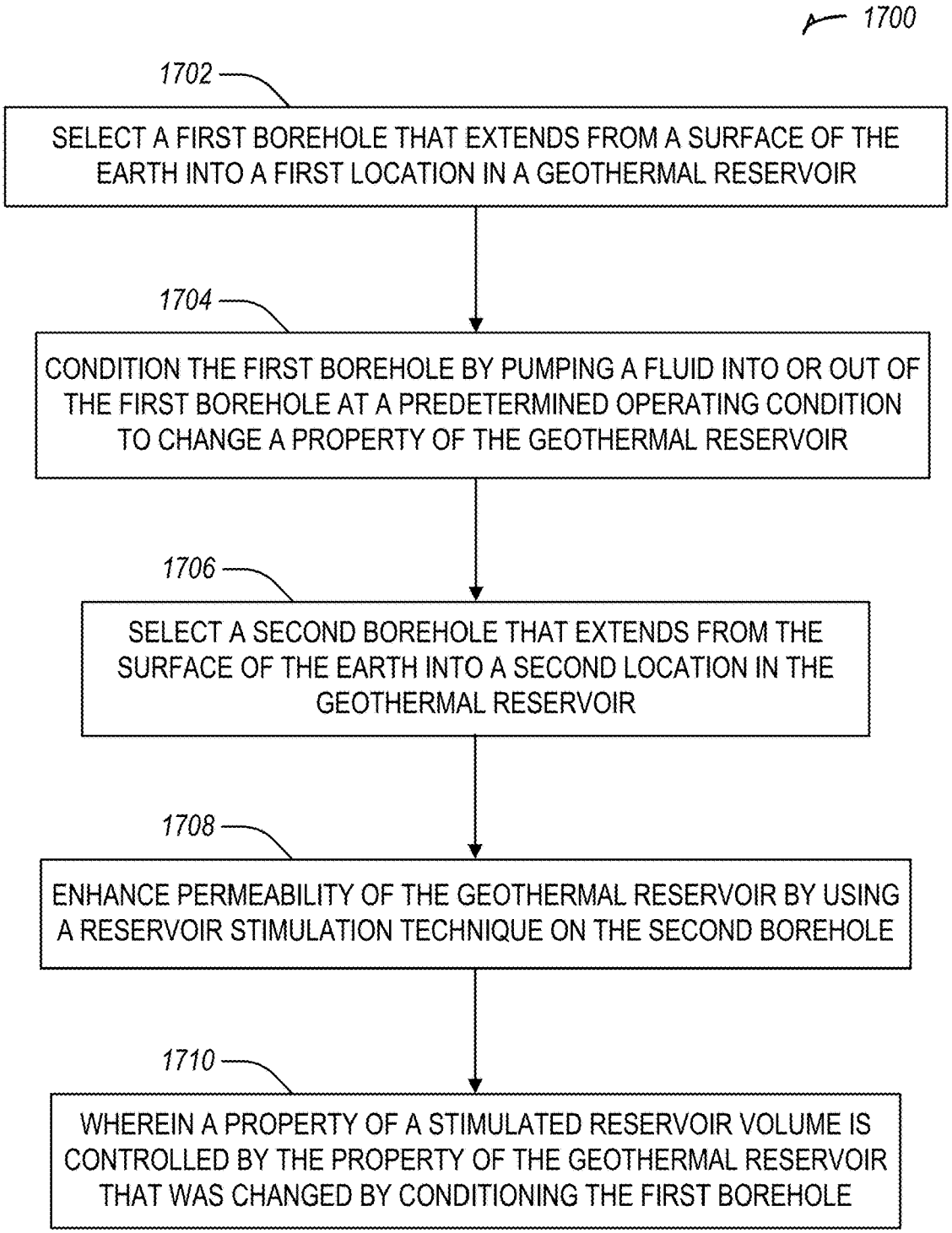
FIG. 17 illustrates an example technique for increasing recovery of a geothermal energy resource in accordance with examples described herein.

FIG. 17 illustrates an example technique for increasing recovery of a geothermal energy resource in accordance with examples described herein.

The technique 1700 includes an operation 1702 to select a first borehole that extends from a surface of the earth into a first location in a geothermal reservoir.

The technique 1700 includes an operation 1704 to condition the first borehole by pumping a fluid into or out of the first borehole at a predetermined operating condition to change a property of the geothermal reservoir. In an example, the predetermined operating condition of the first borehole is one of at least a flow rate, an injection pressure, a bottomhole pressure, or a fluid temperature. For example, the flow rate may be an injection rate or production rate ranging from about 1000 barrels per day to 50000 barrels per day. The injection pressure may be about 250 psi to about 3000 psi. The bottomhole pressure may be about 250 psi to 3000 psi below an initial reservoir pressure. The fluid temperature may be about 50 degrees Fahrenheit to about 200 degrees Fahrenheit.

In an example, the property of the geothermal reservoir that was changed by conditioning the first borehole includes at least one of a reservoir fluid pressure, a reservoir fluid temperature, a reservoir stress, a reservoir poroelastic stress, a reservoir thermoelastic stress, or the like. For example, this change may include a reservoir fluid pressure change of about 250 psi to 3000 psi. This change may include a reservoir fluid temperature change of about 50 degrees Fahrenheit to about 200 degrees Fahrenheit. This change may include a change in a magnitude of the reservoir stress, the reservoir poroelastic stress, or the reservoir thermoelastic stress of about 250 psi to 3000 psi.

The technique 1700 includes an operation 1706 to select a second borehole that extends from the surface of the earth into a second location in the geothermal reservoir.

The technique 1700 includes an operation 1708 to enhance permeability of the geothermal reservoir by using a reservoir stimulation technique on the second borehole. The reservoir stimulation technique may include a hydraulic fracturing technique or a hydroshearing technique. The hydraulic fracturing technique may include a plug-and perforate method or a sliding sleeve method.

The technique 1700 includes an operation 1710 to wherein a property of a stimulated reservoir volume is controlled by the property of the geothermal reservoir that was changed by conditioning the first borehole. The property of the stimulated reservoir volume may include at least one of a fracture length, a fracture height, a fracture orientation, a fracture dip, a fracture azimuth, a fracture conductivity, a number of fractures, a fractured reservoir volume, a reservoir permeability, a reservoir porosity, or the like.

In some examples, the technique 1700 includes using at least one of proppant, slickwater, or a viscous fluid during the reservoir stimulation technique. In an example, the two boreholes are used to form an injection well and production well pair to recover energy from the geothermal reservoir.

Figure 18:
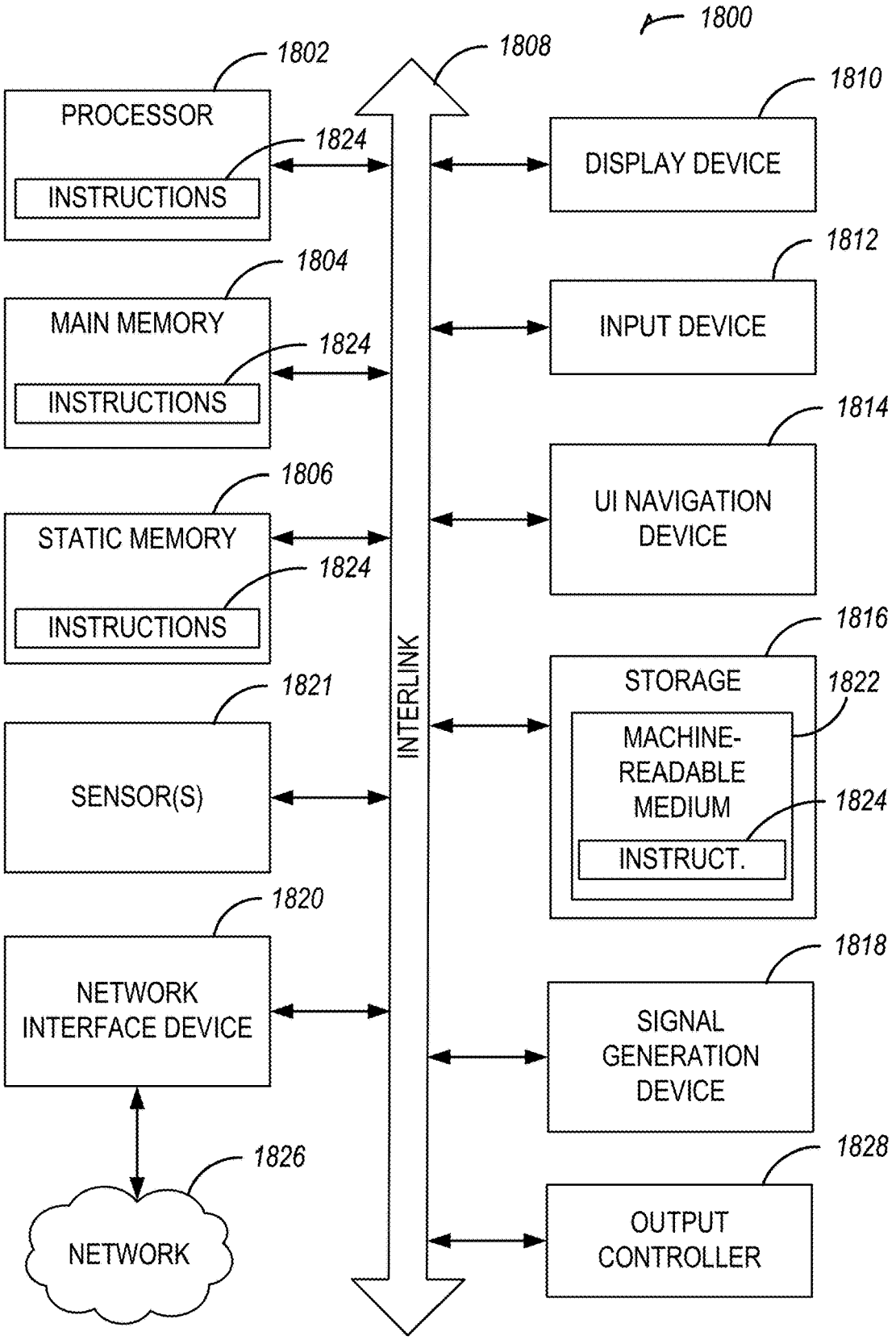
FIG. 18 illustrates generally an example of a block diagram of a machine upon which any one or more of the techniques discussed herein may perform in accordance with examples described herein.

FIG. 18 illustrates generally an example of a block diagram of a machine upon which any one or more of the techniques discussed herein may perform in accordance with examples described herein. In alternative examples, the machine 1800 may operate as a standalone device or may be connected (e.g., networked) to other machines. In a networked deployment, the machine 1800 may operate in the capacity of a server machine, a client machine, or both in server-client network environments. In an example, the machine 1800 may act as a peer machine in peer-to-peer (P2P) (or other distributed) network environment. The machine 1800 may be a personal computer (PC), a tablet PC, a set-top box (STB), a personal digital assistant (PDA), a mobile telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

Examples, as described herein, may include, or may operate on, logic or a number of components, modules, or mechanisms. Modules are tangible entities (e.g., hardware) capable of performing specified operations when operating.

A module includes hardware. In an example, the hardware may be specifically configured to carry out a specific operation (e.g., hardwired). In an example, the hardware may include configurable execution units (e.g., transistors, circuits, etc.) and a computer readable medium containing instructions, where the instructions configure the execution units to carry out a specific operation when in operation. The configuring may occur under the direction of the executions units or a loading mechanism. Accordingly, the execution units are communicatively coupled to the computer readable medium when the device is operating. In this example, the execution units may be a member of more than one module. For example, under operation, the execution units may be configured by a first set of instructions to implement a first module at one point in time and reconfigured by a second set of instructions to implement a second module.

Machine (e.g., computer system) 1800 may include a hardware processor 1802 (e.g., a central processing unit (CPU), a graphics processing unit (GPU), a hardware processor core, or any combination thereof), a main memory 1804 and a static memory 1806, some or all of which may communicate with each other via an interlink (e.g., bus) 1808. The machine 1800 may further include a display unit 1810, an alphanumeric input device 1812 (e.g., a keyboard), and a user interface (UI) navigation device 1814 (e.g., a mouse). In an example, the display unit 1810, alphanumeric input device 1812 and UI navigation device 1814 may be a touch screen display. The machine 1800 may additionally include a storage device (e.g., drive unit) 1816, a signal generation device 1818 (e.g., a speaker), a network interface device 1820, and one or more sensors 1821, such as a global positioning system (GPS) sensor, compass, accelerometer, or other sensor. The machine 1800 may include an output controller 1828, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

The storage device 1816 may include a machine readable medium 1822 that is non-transitory on which is stored one or more sets of data structures or instructions 1824 (e.g., software) embodying or utilized by any one or more of the techniques or functions described herein. The instructions 1824 may also reside, completely or at least partially, within the main memory 1804, within static memory 1806, or within the hardware processor 1802 during execution thereof by the machine 1800. In an example, one or any combination of the hardware processor 1802, the main memory 1804, the static memory 1806, or the storage device 1816 may constitute machine readable media.

While the machine readable medium 1822 is illustrated as a single medium, the term "machine readable medium" may include a single medium or multiple media (e.g., a centralized or distributed database, or associated caches and servers) configured to store the one or more instructions 1824.

The term "machine readable medium" may include any medium that is capable of storing, encoding, or carrying instructions for execution by the machine 1800 and that cause the machine 1800 to perform any one or more of the techniques of the present disclosure, or that is capable of storing, encoding or carrying data structures used by or associated with such instructions. Non-limiting machine-readable medium examples may include solid-state memories, and optical and magnetic media. Specific examples of machine-readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 1824 may further be transmitted or received over a communications network 1826 using a transmission medium via the network interface device 1820 utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, peer-to-peer (P2P) networks, among others. In an example, the network interface device 1820 may include one or more physical jacks (e.g., Ethernet, coaxial, or phone jacks) or one or more antennas to connect to the communications network 1826. In an example, the network interface device 1820 may include a plurality of antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by the machine 1800, and includes digital or analog communications signals or other intangible medium to facilitate communication of such software.

In view of the disclosure above, various examples are set forth below. It should be noted that one or more features of an example, taken in isolation or combination, should be considered within the disclosure of this application.

Example 1 is a method to increase recovery of a resource from the earth, the method comprising: obtaining formation information relating to a first well, the first well comprising a borehole extending from a surface of the earth into a location in a reservoir including an energy reserve; pumping a fluid under pressure down a second well under a predetermined pressure and a predetermined flow rate the predetermined pressure or the predetermined flow rate predetermined based in part on the formation information; wherein pumping the fluid under pressure causes an improvement in a property of the formation near the borehole of the first well and in the reservoir.

In Example 2, the subject matter of Example 1 includes, wherein the energy reserve comprises a source of geothermal energy.

In Example 3, the subject matter of Example 2 includes, wherein the second well comprises a second borehole that extends into the earth, wherein the second borehole has a stimulation section located a distance from the location of the borehole, wherein the fluid is pump out of the stimulation section into the formation.

In Example 4, the subject matter of Examples 2-3 includes, wherein the second well comprises a second borehole that extends into the earth, wherein the second borehole has a stimulation section, defined by a plug located at a depth below a perforation section, wherein the fluid is pump out of the stimulation section into the formation.

In Example 5, the subject matter of Examples 1-4 includes, wherein the energy reserve comprises a hydrocarbon.

In Example 6, the subject matter of Example 5 includes, wherein the second well comprises a second borehole that extends into the earth, wherein the second borehole has a stimulation section located a distance from the location of the borehole, wherein the fluid is pump out of the stimulation section into the formation.

In Example 7, the subject matter of Examples 5-6 includes, wherein the second well comprises a second borehole that extends into the earth, wherein the second borehole has a stimulation section, defined by a plug located at a depth below a perforation section, wherein the fluid is pump out of the stimulation section into the formation.

In Example 8, the subject matter of Examples 1-7 includes, wherein the energy reserve comprises a crude oil.

In Example 9, the subject matter of Example 8 includes, wherein the second well comprises a second borehole that extends into the earth, wherein the second borehole has a stimulation section located a distance from the location of the borehole, wherein the fluid is pump out of the stimulation section into the formation.

In Example 10, the subject matter of Examples 8-9 includes, wherein the second well comprises a second borehole that extends into the earth, wherein the second borehole has a stimulation section, defined by a plug located at a depth below a perforation section, wherein the fluid is pump out of the stimulation section into the formation.

In Example 11, the subject matter of Examples 1-10 includes, wherein the second well comprises a second borehole that extends into the earth, wherein the second borehole has a stimulation section located a distance from the location of the borehole, wherein the fluid is pump out of the stimulation section into the formation.

In Example 12, the subject matter of Example 11 includes, wherein the stimulation section is located a distance from the location of the borehole in the reservoir, wherein the distance is from about 20 feet to about 2,000 ft.

In Example 13, the subject matter of Examples 11-12 includes, wherein the stimulation section is located a distance from the location of the borehole in the reservoir, wherein the distance is from about 100 feet to about 1,000 ft.

In Example 14, the subject matter of Examples 11-13 includes, wherein the stimulation section is located a distance from the location of the borehole in the reservoir, wherein the distance is less than about 2,000 ft.

In Example 15, the subject matter of Examples 11-14 includes, wherein the stimulation section is located a distance from the location of the borehole in the reservoir, wherein the distance is less than about 1,000 ft.

In Example 16, the subject matter of Examples 11-15 includes, wherein the stimulation section is located a distance from the location of the borehole in the reservoir, wherein the distance is less than about 1,000 ft; wherein the fluid is pumped in a series of stages.

In Example 17, the subject matter of Examples 11-16 includes, wherein the stimulation section is located a distance from the location of the borehole in the reservoir, wherein the distance is less than about 2,000 ft; wherein the fluid is pumped in a series of stages, wherein the stages comprise a first pressure, a second pressure that is different from the first pressure and a hold time.

In Example 18, the subject matter of Examples 1-17 includes, wherein the second well comprises a second borehole that extends into the earth, wherein the second borehole has a stimulation section, defined by a plug located at a depth below a perforation section, wherein the fluid is pump out of the stimulation section into the formation.

Example 19 is a method to increase recovery of a resource from the earth, the method comprising: obtaining formation information relating to a first well, wherein the first well comprises a borehole extending from a surface of the earth into a location in a reservoir containing an energy reserve, the formation information comprising a poroelasticity stress of the reservoir; and pumping a fluid under pressure down a second well under a predetermined pressure and a predetermined flow rate, the predetermined pressure or the predetermined flow rate being predetermined based in part on the formation information; wherein pumping the fluid under pressure causes an improvement in a property of the formation near the borehole of the first well and in the reservoir.

In Example 20, the subject matter of Example 19 includes, wherein the energy reserve comprises a source of geothermal energy.

In Example 21, the subject matter of Example 20 includes, wherein the second well comprises a second borehole that extends into the earth, wherein the second borehole has a stimulation section located a distance from the location of the borehole, wherein the fluid is pump out of the stimulation section into the formation.

In Example 22, the subject matter of Examples 19-21 includes, wherein the energy reserve comprises a hydrocarbon.

In Example 23, the subject matter of Example 22 includes, wherein the second well comprises a second borehole that extends into the earth, wherein the second borehole has a stimulation section located a distance from the location of the borehole, wherein the fluid is pump out of the stimulation section into the formation.

In Example 24, the subject matter of Examples 19-23 includes, wherein the energy reserve comprises a crude oil.

In Example 25, the subject matter of Example 24 includes, wherein the second well comprises a second borehole that extends into the earth, wherein the second borehole has a stimulation section located a distance from the location of the borehole, wherein the fluid is pump out of the stimulation section into the formation.

In Example 26, the subject matter of Examples 19-25 includes, wherein the second well comprises a second borehole that extends into the earth, wherein the second borehole has a stimulation section located a distance from the location of the borehole, wherein the fluid is pump out of the stimulation section into the formation.

Example 27 is a method to increase recovery of a resource from the earth, the method comprising: obtaining formation information relating to a first well, wherein the first well comprises a borehole extending from a surface of the earth into a location in a reservoir containing an energy reserve; and, pumping a fluid under pressure down a second well under a predetermined pressure and a predetermined flow rate, the predetermined pressure or the predetermined flow rate being predetermined based in part on the formation information; wherein pumping the fluid causes fractures to be propagated into a low-stress region of the reservoir near the borehole.

In Example 28, the subject matter of Example 27 includes, wherein the formation information comprises a poroelasticity stress of the reservoir.

Example 29 is a method to increase recovery of a resource from the earth, the method comprising: obtaining formation information relating to a first well, wherein the first well comprises a borehole extending from a surface of the earth into a location in a reservoir containing an energy reserve; and, pumping a fluid under pressure down a second well under a predetermined pressure and a predetermined flow rate, the predetermined pressure or the predetermined flow rate being predetermined based in part on the formation information; wherein pumping the fluid causes fractures that are propagated in a turning and branching configuration in the reservoir near the borehole.

In Example 30, the subject matter of Example 29 includes, wherein the formation information comprises a poroelasticity stress of the reservoir.

Example 31 is a method to increase recovery of a resource from the earth, the method comprising: obtaining formation information relating to a first well, wherein the first well comprises a borehole extending from a surface of the earth into a location in a reservoir containing an energy reserve; and pumping a first fluid under pressure down a second well under a predetermined pressure and a predetermined flow rate; pumping a second fluid comprising a proppant under pressure down the first well under a predetermined pressure and a predetermined flow rate; wherein one or more of the predetermined pressure, the predetermined flow rate, the first fluid pumping, or the second fluid pumping occur based in part on the formation information; wherein fractures are propagated in the reservoir near the borehole.

In Example 32, the subject matter of Example 31 includes, wherein the formation information comprises a poroelasticity stress of the reservoir.

Example 33 is a method to increase recovery of a geothermal energy resource, the method comprising: selecting a first borehole that extends from a surface of the earth into a first location in a geothermal reservoir; conditioning the first borehole by pumping a fluid into or out of the first borehole at a predetermined operating condition to change a property of the geothermal reservoir; selecting a second borehole that extends from the surface of the earth into a second location in the geothermal reservoir; and enhancing permeability of the geothermal reservoir by using a reservoir stimulation technique on the second borehole; wherein a property of a stimulated reservoir volume is controlled by the property of the geothermal reservoir that was changed by conditioning the first borehole.

In Example 34, the subject matter of Example 33 includes, wherein the predetermined operating condition of the first borehole is one of at least a flow rate, an injection pressure, a bottomhole pressure, or a fluid temperature.

In Example 35, the subject matter of Example 34 includes, wherein the flow rate is an injection rate or production rate ranging from about 1000 barrels per day to 50000 barrels per day.

In Example 36, the subject matter of Examples 34-35 includes, wherein the injection pressure is about 250 psi to about 3000 psi.

In Example 37, the subject matter of Examples 34-36 includes, wherein the bottomhole pressure is about 250 psi to 3000 psi below an initial reservoir pressure.

In Example 38, the subject matter of Examples 34-37 includes, wherein the fluid temperature is about 50 degrees Fahrenheit to about 200 degrees Fahrenheit.

In Example 39, the subject matter of Examples 33-38 includes, wherein the property of the geothermal reservoir that was changed by conditioning the first borehole is one of at least a reservoir fluid pressure, a reservoir fluid temperature, a reservoir stress, a reservoir poroelastic stress, or a reservoir thermoelastic stress.

In Example 40, the subject matter of Example 39 includes, wherein the reservoir fluid pressure change is about 250 psi to 3000 psi.

In Example 41, the subject matter of Examples 39-40 includes, wherein the reservoir fluid temperature change is about 50 degrees Fahrenheit to about 200 degrees Fahrenheit.

In Example 42, the subject matter of Examples 39-41 includes, wherein the change in a magnitude of the reservoir stress, the reservoir poroelastic stress, or the reservoir thermoelastic stress is about 250 psi to 3000 psi.

In Example 43, the subject matter of Examples 33-42 includes, wherein the reservoir stimulation technique is a hydraulic fracturing technique or a hydroshearing technique.

In Example 44, the subject matter of Example 43 includes, wherein the hydraulic fracturing technique is a plug-and perforate method or a sliding sleeve method.

In Example 45, the subject matter of Examples 33-44 includes, wherein the property of the stimulated reservoir volume is one of at least a fracture length, a fracture height, a fracture orientation, a fracture dip, a fracture azimuth, a fracture conductivity, a number of fractures, a fractured reservoir volume, a reservoir permeability, or a reservoir porosity.

In Example 46, the subject matter of Examples 33-45 includes, wherein one of at least proppant, slickwater, or a viscous fluid is used during the reservoir stimulation technique.

In Example 47, the subject matter of Examples 33-46 includes, wherein the two boreholes are used to form an injection well and production well pair to recover energy from the geothermal reservoir.

Example 48 is a method to increase recovery of a geothermal energy resource, the method comprising: selecting a first borehole that extends from a surface of the earth into a first location in a geothermal reservoir; conditioning the first borehole by pumping a fluid out of the first borehole to decrease fluid pressure in the geothermal reservoir near the first borehole; selecting a second borehole that extends from the surface of the earth into a second location in the geothermal reservoir; and enhancing permeability of the geothermal reservoir by using a reservoir stimulation technique on the second borehole; wherein a stimulated reservoir volume grows toward the first borehole.

Example 49 is a method to increase recovery of a geothermal energy resource, the method comprising: selecting a first borehole that extends from a surface of the earth into a first location in a geothermal reservoir; conditioning the first borehole by pumping a fluid out of the first borehole to decrease fluid pressure and induce a reduction in a poroelastic stress in the geothermal reservoir near the first borehole; selecting a second borehole that extends from the surface of the earth into a second location in the geothermal reservoir; and enhancing permeability of the geothermal reservoir by using a reservoir stimulation technique on the second borehole; wherein a stimulated reservoir volume grows toward the first borehole.

Example 50 is a method to increase recovery of a geothermal energy resource, the method comprising: selecting a first borehole that extends from a surface of the earth into a first location in a geothermal reservoir; conditioning the first borehole by pumping a fluid into the first borehole to increase fluid pressure in the geothermal reservoir near the first borehole; selecting a second borehole that extends from the surface of the earth into a second location in the geothermal reservoir; and enhancing permeability of the geothermal reservoir by using a reservoir stimulation technique on the second borehole; wherein a stimulated reservoir volume grows away from the first borehole.

Example 51 is a method to increase recovery of a geothermal energy resource, the method comprising: selecting a first borehole that extends from a surface of the earth into a first location in a geothermal reservoir; conditioning the first borehole by pumping a fluid into the first borehole to increase fluid pressure and induce an increase in a poroelastic stress in the geothermal reservoir near the first borehole; selecting a second borehole that extends from the surface of the earth into a second location in the geothermal reservoir; and enhancing permeability of the geothermal reservoir by using a reservoir stimulation technique on the second borehole; wherein a stimulated reservoir volume grows away from the first borehole.

Example 52 is a method to increase recovery of a geothermal energy resource, the method comprising: selecting a first borehole that extends from a surface of the earth into a first location in a geothermal reservoir; conditioning the first borehole by pumping a fluid with a predetermined temperature that is colder than a reservoir temperature into the first borehole to reduce the reservoir temperature and induce a reduction in a thermoelastic stress in the geothermal reservoir near the first borehole; selecting a second borehole that extends from the surface of the earth into a second location in the geothermal reservoir; and enhancing permeability of the geothermal reservoir by using a reservoir stimulation technique on the second borehole; wherein a stimulated reservoir volume grows toward the first borehole.

Example 54 is an apparatus comprising means to implement of any of Examples 1-52.

Example 55 is a system to implement of any of Examples 1-52.

Example 56 is a method to implement of any of Examples 1-52.

The above detailed description includes references to the accompanying drawings, which form a part of the detailed description. The drawings show, by way of illustration, specific examples in which the inventive subject matter can be practiced. Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

The above description is intended to be illustrative, and not restrictive. For example, the above-described examples (or one or more aspects thereof) may be used in combination with each other. Other examples can be used, such as by one of ordinary skill in the art upon reviewing the above description. The Abstract is provided to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed example. Thus, the following claims are hereby incorporated into the Detailed Description as examples, with each claim standing on its own as a separate example, and it is contemplated that such examples can be combined with each other in various combinations or permutations. The scope of the inventive subject matter should be determined with reference to the appended claims, along with the full scope of equivalents to which such claims are entitled.

What is claimed is:

1. A method to increase recovery of a geothermal energy resource, the method comprising:

selecting a first borehole that extends from a surface of the earth into a first location in a geothermal reservoir;

conditioning the first borehole by pumping a fluid into the first borehole at a predetermined operating condition to change a property of the geothermal reservoir, wherein the predetermined operating condition of the first borehole is at least one of a flow rate, an injection pressure, a bottomhole pressure, or a fluid temperature, and wherein the property of the geothermal reservoir is at least one of a reservoir fluid pressure, a reservoir fluid temperature, a reservoir stress, a reservoir poroelastic stress, or a reservoir thermoelastic stress;

selecting a second borehole that extends from the surface of the earth into a second location in the geothermal reservoir and a third borehole that extends from the surface of the earth into a third location in the geothermal reservoir; and enhancing permeability of the geothermal reservoir by using a reservoir stimulation technique on the first borehole to cause a same number of fractures to intersect the second borehole and the third borehole through asymmetric propagation of the fractures;

wherein a property of a stimulated reservoir volume is controlled by the property of the geothermal reservoir that was changed by conditioning the first borehole, wherein the property of the stimulated reservoir volume is at least one of a fracture length, a fracture height, a fracture orientation, a fracture dip, a fracture azimuth, a fracture conductivity, a number of fractures, a fractured reservoir volume, a reservoir permeability, a reservoir fluid pressure, or a reservoir porosity.

2. The method of claim 1, further comprising:

circulating a working fluid through the geothermal reservoir to recover the geothermal energy resource.

3. The method of claim 2, wherein the injection pressure is about 250 psi to about 3000 psi.

4. The method of claim 2, wherein the fluid temperature is about 50 degrees Fahrenheit to about 200 degrees Fahrenheit.

5. The method of claim 1, wherein the predetermined operating condition of the first borehole is the flow rate, and the flow rate is an injection rate or production rate ranging from about 1000 barrels per day to 50000 barrels per day.

6. The method of claim 1, further comprising:

conditioning the first borehole by pumping fluid out of the first borehole to decrease fluid pressure in the geothermal reservoir near the first borehole and cause symmetric propagation of the fractures.

7. The method of claim 6, wherein the bottomhole pressure is about 250 psi to 3000 psi below an initial reservoir pressure.

8. The method of claim 6, wherein the reservoir fluid temperature change is about 50 degrees Fahrenheit to about 200 degrees Fahrenheit.

9. The method of claim 6, wherein the change in a magnitude of the reservoir stress, the reservoir poroelastic stress, or the reservoir thermoelastic stress is about 250 psi to 3000 psi.

10. The method of claim 1, wherein the property of the geothermal reservoir that was changed by conditioning the first borehole is the reservoir fluid pressure, and a change to the reservoir fluid pressure is about 250 psi to 3000 psi.

11. The method of claim 1, wherein the reservoir stimulation technique is a hydraulic fracturing technique or a hydroshearing technique.

12. The method of claim 11, wherein the hydraulic fracturing technique is a plug-and perforate method or a sliding sleeve method.

13. The method of claim 1, wherein enhancing permeability of the geothermal reservoir comprises:

causing proppant in a fracture in the geothermal reservoir to become immobilized by dropping the reservoir fluid pressure below a normal stress acting on the fracture; and causing even distribution of proppant within a fracture in the geothermal reservoir.

14. The method of claim 1, wherein one of at least proppant, slickwater, or a viscous fluid is used during the reservoir stimulation technique.

15. The method of claim 1, wherein the three boreholes are used to form an injection well and production well pair to recover energy from the geothermal reservoir.

16. A method to increase recovery of a geothermal energy resource, the method comprising:

selecting a first borehole that extends from a surface of the earth into a first location in a geothermal reservoir and a second borehole that extends from the surface of the earth into a second location in the geothermal reservoir;

conditioning the first borehole by pumping a fluid out of the first borehole to decrease first fluid pressure in the geothermal reservoir near the first borehole;

conditioning the second borehole by pumping the fluid out of the second borehole to decrease second fluid pressure in the geothermal reservoir near the second borehole;

selecting a third borehole that extends from the surface of the earth into a third location in the geothermal reservoir; and enhancing permeability of the geothermal reservoir by using a reservoir stimulation technique on the third borehole to cause a same number of fractures to intersect the first borehole and the second borehole through asymmetric propagation of the fractures;

wherein a stimulated reservoir volume grows toward the first borehole.

17. A method to increase recovery of a geothermal energy resource, the method comprising:

selecting a first borehole that extends from a surface of the earth into a first location in a geothermal reservoir and a second borehole that extends from the surface of the earth into a second location in the geothermal reservoir;

conditioning the first borehole by pumping a fluid out of the first borehole to decrease first fluid pressure and induce a first reduction in a first poroelastic stress in the geothermal reservoir near the first borehole;

conditioning the second borehole by pumping the fluid out of the second borehole to decrease second fluid pressure and induce a second reduction in a second poroelastic stress in the geothermal reservoir near the second borehole;

selecting a third borehole that extends from the surface of the earth into a second location in the geothermal reservoir; and enhancing permeability of the geothermal reservoir by using a reservoir stimulation technique on the third borehole to cause a same number of fractures to intersect the first borehole and the second borehole through asymmetric propagation of the fractures;

wherein a stimulated reservoir volume grows toward the first borehole.

* * * * *